US009229422B2

(12) United States Patent
Yamamoto

(10) Patent No.: US 9,229,422 B2
(45) Date of Patent: Jan. 5, 2016

(54) DEVELOPER SUPPLYING APPARATUS

(71) Applicant: CANON KABUSHIKI KAISHA, Tokyo (JP)

(72) Inventor: Tatsuyuki Yamamoto, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/448,029

(22) Filed: Jul. 31, 2014

(65) Prior Publication Data

US 2015/0043944 A1 Feb. 12, 2015

(30) Foreign Application Priority Data

Aug. 12, 2013 (JP) ..... 2013-167338

(51) Int. Cl.
*G03G 15/08* (2006.01)
*G03G 21/16* (2006.01)

(52) U.S. Cl.
CPC ..... *G03G 21/1676* (2013.01); *G03G 15/0867* (2013.01); *G03G 15/0881* (2013.01); *G03G 15/0886* (2013.01)

(58) Field of Classification Search
CPC ..... G03G 15/0867; G03G 15/0879; G03G 15/0881; G03G 15/0886
See application file for complete search history.

(56) References Cited

U.S. PATENT DOCUMENTS 8,095,048 B2 * 1/2012 Awano et al. ..... 399/260
8,428,491 B2 4/2013 Yamamoto
8,478,164 B2 7/2013 Yamamoto
8,611,788 B2 12/2013 Yamamoto
2011/0305485 A1 * 12/2011 Oshikawa et al. ..... 399/258
2013/0216263 A1 8/2013 Miyazawa et al.
2013/0223861 A1 8/2013 Kubo et al.
2014/0153974 A1 6/2014 Jimba et al.

FOREIGN PATENT DOCUMENTS

JP 08-110692 A 4/1996
JP 2002-311696 A 10/2002

(Continued)

OTHER PUBLICATIONS

U.S. Appl. No. 14/338,425, filed Jul. 23, 2014.

(Continued)

*Primary Examiner* — Gregory H Curran
(74) *Attorney, Agent, or Firm* — Fitzpatrick, Cella, Harper & Scinto

(57) ABSTRACT

A developer receiving apparatus includes a receiving portion displacably provided and configured to receive developer supplied from a supply container. The receiving portion including a receiving port configured to receive the developer and a first engaging portion engageable with the supply container to displace the receiving portion toward the supply container so as to connect the receiving portion with the supply container in a mounting operation. A covering member is displaceably provided in the receiving apparatus and covers an upper part of the receiving port. The covering member takes a closing position closing the upper part of the receiving port when the supply container is not mounted, and includes a second engaging portion engageable with the receiving portion to displace the covering member to a retracted position retracted from the closing position to permit the receiving portion to connect with the supply container in the mounting operation.

6 Claims, 22 Drawing Sheets

(56) References Cited

FOREIGN PATENT DOCUMENTS

| | | | |
|---|---|---|---|
| JP | 2013-015826 | A | 1/2013 |
| WO | 2012/169657 | A1 | 12/2012 |

OTHER PUBLICATIONS

European Search Report dated Dec. 22, 2014, in related European Patent Application No. 14179512.0.

* cited by examiner (a)

(b)

(a)

(b)

(c)

(a)

(b)

(a)

(b)

(a)

(b)

(a)

(b)

(a)

(b)

(c)

(d)

(a)

(b)

(c)

(d)

(a)

(b)

(c)

(d)

(a)

(b)

(c)

(d)

(a)

(b)

DEVELOPER SUPPLYING APPARATUS

FIELD OF THE INVENTION AND RELATED ART

The present invention relates to a developer supplying apparatus for supplying a developer in an image forming apparatus such as a copying machine, a printer, a facsimile machine, a complex machine thereof or the like which forms an image using a developer.

Conventionally, in the image forming apparatus of an electrophotographic type such as a copying machine, a developer in the form of fine particles such as toner powder is used. In such an image forming apparatus, the developer consumed in accordance with the image formation is compensated by a developer supplying apparatus. The supply of the developer is carried out by mounting a developer supply container accommodating the developer to a developer receiving portion provided in a main assembly of the apparatus. Here, since the developer is extremely fine powder, the developer may scatter during the mounting and demounting operation of the developer supply container. Therefore, various connecting types between the developer supply container and the developer receiving portion have been proposed and used (Japanese Laid-open Patent Application Hei 8-110692, for example).

With the structure disclosed in Japanese Laid-open Patent Application Hei 8-110692, the developer supply container accommodating the developer which is slidable relative to the main assembly, and in the state that the developer supply container is set in the main assembly, the discharge opening of the developer supply container is placed right above a receiving opening of the developing device. In the developing operation, the whole developing device is moved up to place a discharge opening and the receiving opening in a connecting state (the openings are in fluid communication with each other). On the other hand, in the non-developing-operation period, the whole developing device is moved down to separate the receiving opening from the discharge opening.

However, with this structure, it is necessary to keep open the receiving opening, and therefore, foreign matter may enter through the receiving opening.

Under the circumstances, the present invention is to provide an apparatus with which a developer receiving portion having a receiving opening for receiving the developer is moved to connect the receiving opening to the discharge opening of a developer supply container, and the entering of the foreign matter through the receiving opening is suppressed.

SUMMARY OF THE INVENTION

According to an aspect of the present invention, there is provided a supplying apparatus comprising a mounting portion configured to mount a supply container accommodating a developer, wherein said supply container includes a discharge opening detachably mountable to said mounting portion and configured to discharge the developer; a receiving portion capable of receiving the developer, said receiving portion including a receiving opening which opens upwardly and connectable with said discharge opening to receive the developer discharged through said discharge opening when said supply container is mounting to said mounting portion; a first moving mechanism configured to move said receiving portion to and away from a position of said discharge opening in interrelation with mounting and demounting operation of said supply container; a covering member provided in a position opposing and above said receiving opening and movable between a covering position covering said receiving opening and an open position opening said receiving opening; a second moving mechanism configured to move said covering member from the covering position to the open position with the mounting operation of said supply container.

Further features of the present invention will become apparent from the following description of exemplary embodiments with reference to the attached drawings.

These and other objects, features and advantages of the present invention will become more apparent upon a consideration of the following description of the preferred embodiments of the present invention taken in conjunction with the accompanying drawings.

DESCRIPTION OF THE EMBODIMENTS

Figure 1:
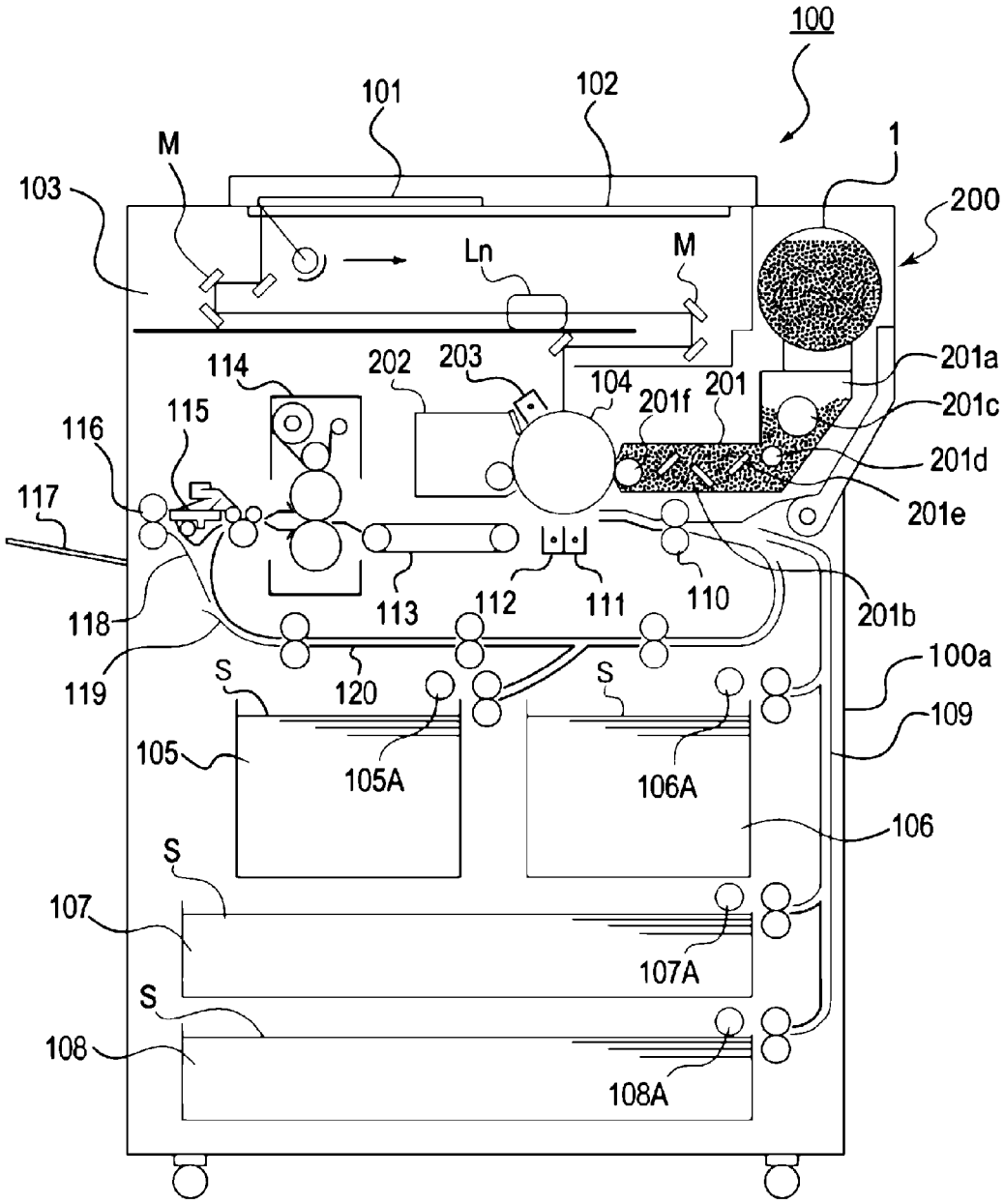
FIG. 1 is a schematic sectional view of an image forming apparatus to which the present invention is applicable.
Figure 2:
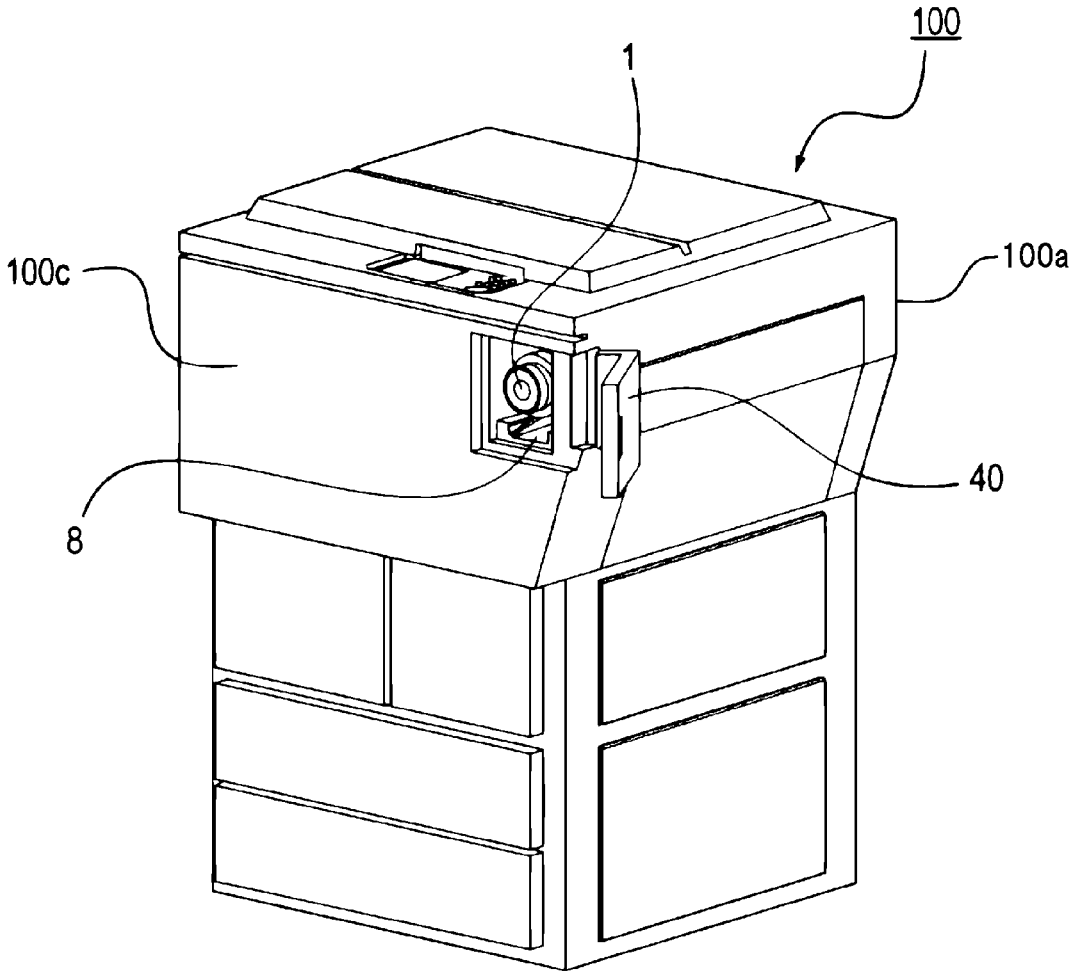
FIG. 2 is a perspective view of the image forming apparatus.

Referring to FIG. 1 to FIG. 19, an example of an image forming apparatus and a developer supplying apparatus to which the present invention is applicable. Referring first to FIGS. 1 and 2, a basic structure of such an image forming apparatus will be described.

[Image Forming Apparatus]

In FIG. 1, designated by 100 is the image forming apparatus. Designated by 101 is an original placed on an original supporting platen glass 102. A light image corresponding to image information of the original is imaged on an electrophotographic photosensitive member 104 (photosensitive member) by way of a plurality of mirrors M of an optical portion 103 and a lens Ln, so that an electrostatic latent image is formed. The electrostatic latent image is visualized with toner (one component magnetic toner) as a developer (dry powder) by a dry type developing device (one component developing device) 201*a*. In this embodiment, the one component magnetic toner is used as the developer to be supplied from a developer supply container (toner cartridge) 1, but the present invention is not limited to the example and includes other examples which will be described hereinafter.

Specifically, in the case that a one component developing device using the one component non-magnetic toner is employed, the one component non-magnetic toner is supplied as the developer. In addition, in the case that a two component developing device using a two component developer containing mixed magnetic carrier and non-magnetic toner is employed, the non-magnetic toner is supplied as the developer. In such a case, both of the non-magnetic toner and the magnetic carrier may be supplied as the developer.

As described hereinbefore, the developing device 201 of FIG. 1 develops, using the developer, the electrostatic latent image formed on the photosensitive drum 104 on the basis of image information of the original 101. To the developing device 201, a developer supplying apparatus 200 is connected, and the developer supplying apparatus 200 comprises a developer supply container 1 and a developer receiving apparatus 8 to which the developer supply container 1 is detachably mountable. The developer supplying apparatus 200 will be described in detail hereinafter.

The developing device 201 is provided with a developing roller 201*f* in addition to the developer hopper portion 201*a*. The developer hopper portion 201*a* is provided with a stirring member 201*c* for stirring the developer supplied from the developer supply container 1. The developer stirred by the stirring member 201*c* is fed to the feeding member 201*e* by a feeding member 201*d*. The developer having been fed by the feeding members 201*e*, 201*b* in the order named is supplied finally to a developing zone relative to the photosensitive drum 104 while being carried on the developing roller 201*f*. In this example, the toner as the developer is supplied from the developer supply container 1 to the developing device 201, but another system may be used, and the toner and the carrier functioning developer may be supplied from the developer supply container 1, for example.

Designated by 105-108 in FIG. 1 are cassettes accommodating recording materials S such as sheets. Of the recording materials S stacked in the cassettes 105-108, a optimum cassette is selected on the basis of a sheet size of the original 101 or information inputted by the operator (user) from a liquid operating portion of the image forming apparatus. The recording material is not limited to a sheet of paper, but OHP sheet or another material can be used as desired. One recording material S supplied by a separation and feeding device 105A-108A is fed to registration rollers 110 along a feeding portion 109, and is fed at timing synchronized with rotation of a photosensitive drum 104 and with scanning of an optical portion 103.

Designated by 111, 112 are a transfer charger and a separation charger. An image (toner image) of the developer formed on the photosensitive drum 104 is transferred onto the recording material S by a transfer charger 111. The recording material S carrying the toner image it is separated from the photosensitive drum 104 by a separation charger 112. Thereafter, the recording material S fed by the feeding portion 113 is subjected to heat and pressure in a fixing portion 114 so that the developed image on the recording material is fixed, and then passes through a discharging/reversing portion 115, in the case of one-sided copy mode, and subsequently the sheet S is discharged to a discharging tray 117 by discharging rollers 116.

On the other hand, in the case of a duplex copy, the recording material S is fed through the discharging/reversing portion 115, and a part of the recording material S is temporarily discharged to an outside by a discharging roller 116. The trailing end of the recording material S passes through a flapper 118, and a flapper 118 is controlled when it is still nipped by the discharging rollers 116, and the discharging rollers 116 are rotated reversely, so that the recording material S is refed into the apparatus. Then, the sheet S is fed to the registration rollers 110 by way of re-feeding portions 119, 120, and then conveyed along the path similarly to the case of the one-sided copy mode and is discharged to the discharging tray 117.

In the image forming apparatus 100 having such a structure, around the photosensitive drum 104, there are provided image forming process equipment such as a developing device 201*a* as the developing means a cleaner portion 202 as a cleaning means, a primary charger 203 as charging means. The developing device 201 develops the electrostatic latent image formed on the photosensitive drum 104 by the optical portion 103 in accordance with image information of the 101, by depositing the developer onto the latent image. The primary charger 203 uniformly charges a surface of the photosensitive drum for the purpose of forming a desired electrostatic image on the photosensitive drum 104. The cleaner portion 202 removes the developer remaining on the photosensitive drum 104.

As shown in FIG. 2, when a exchange cover 40 which is a part of a outer casing of the main assembly 100*a* of the image forming apparatus 100, a part of a developer receiving apparatus 8 is exposed. By inserting (mounting) the developer supply container 1 into the developer receiving apparatus 8, the developer supply container 1 is set in the state capable of supplying the developer into the developer receiving apparatus 8. On the other hand, when the operator exchanges the developer supply container 1 the developer supply container 1 is taken out (disengaged) from the developer receiving apparatus 8 through the operation reciprocal to the mounting operation, and a new developer supply container 1 is set. Here, the exchange cover 40 is exclusively for mounting and demounting (exchange) of the developer supply container 1, and is opened and closed for mounting and demounting the developer supply container 1. For other maintenance operations for the apparatus 100, a front cover 100*c* is opened and closed. The exchange cover 40 and the front cover 100*c* may be made integral with each other, and in this case, the exchange of the developer supply container 1 and the maintenance of the image forming apparatus 100 are carried out with opening and closing of the integral cover (unshown).

[Developer Receiving Apparatus]

Figure 3:
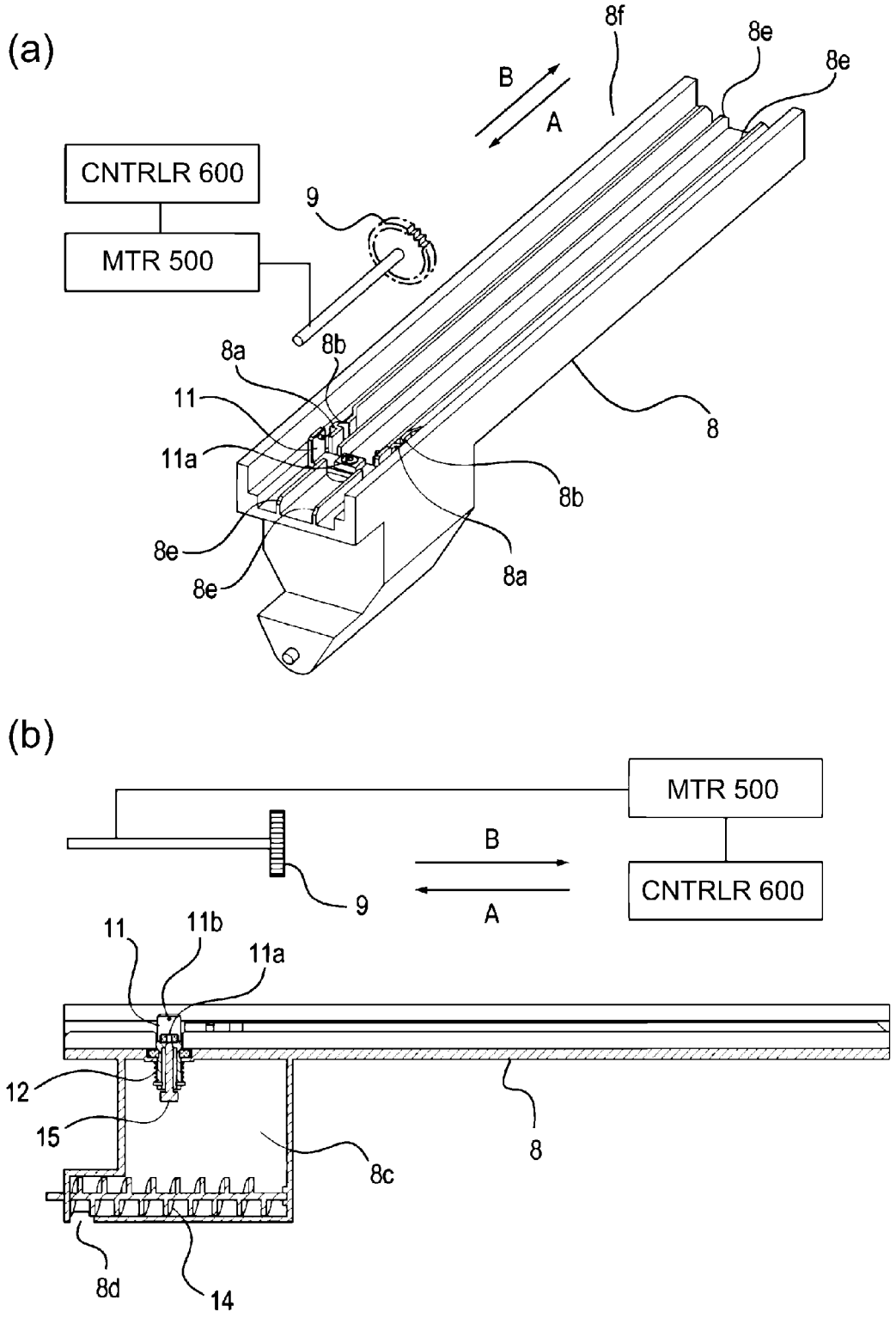
FIG. 3 is a perspective view (a) and a sectional view (b).
Figure 4:
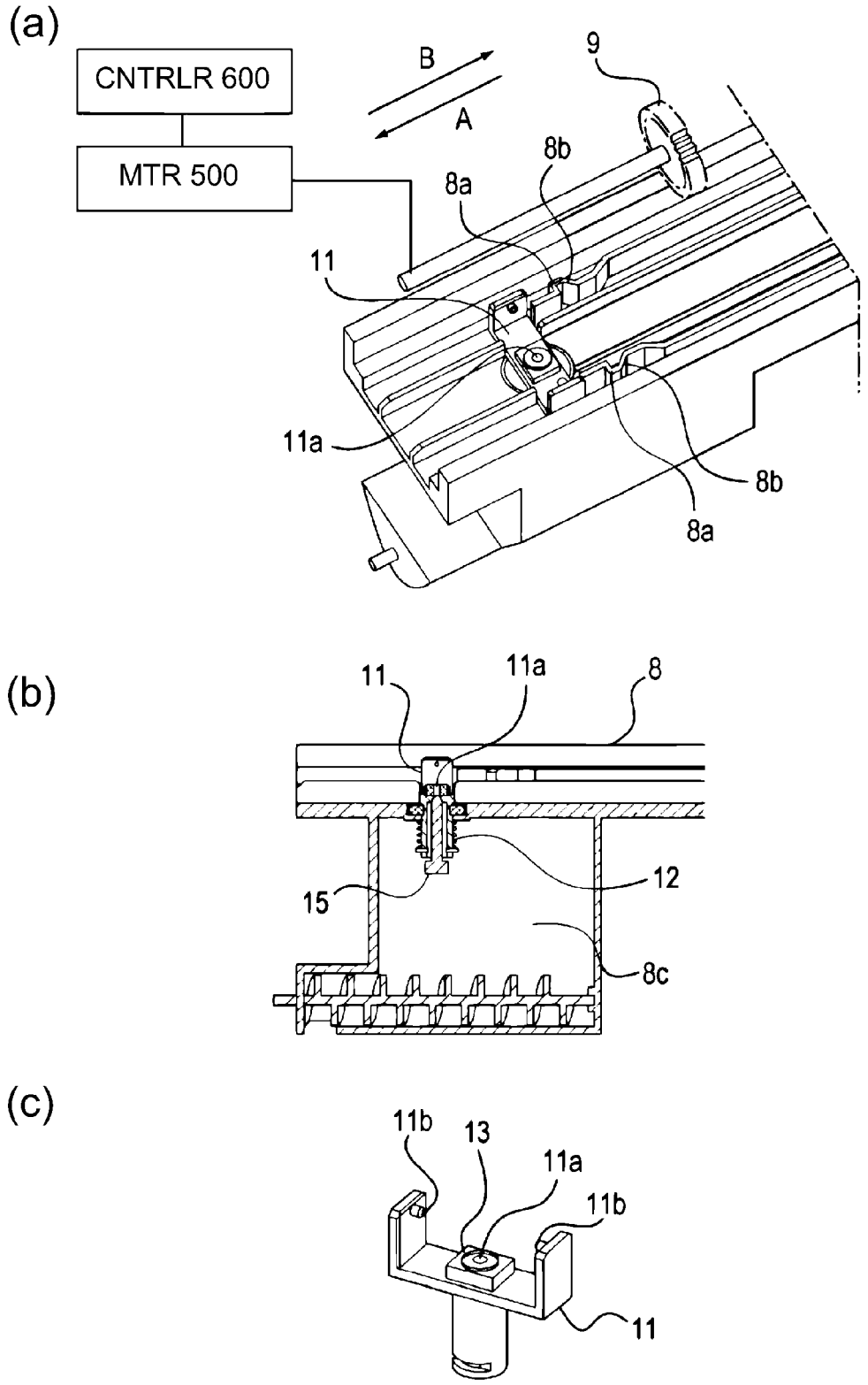
FIG. 4 is a partial enlarged perspective view (a), a partial enlarged sectional view (b), and a developer receiving portion (c) of the developer receiving apparatus.

Referring to FIGS. 3 and 4 the developer receiving apparatus 8 will be described. As shown in part (a) of FIG. 3, the developer receiving apparatus 8 is provided with a mounting portion (mounting space) 8*f* into which the developer supply container 1 is removably (detachably) mounted. It is also provided with a developer receiving portion 11 for receiving the developer discharged through a discharge opening 3*a*4 (part (b) of FIG. 7), which will be described hereinafter, of the developer supply container 1.

The developer receiving portion 11 is capable of receiving the developer supply container 1 and is provided with a developer receiving opening 11*a* for receiving the developer through the discharge opening 3*a*4 and the discharge opening 3*a*4 connected with each other, when it receives the developer supply container 1. In addition, the developer receiving portion 11 is mounted so as to be movable (displaceable) in a direction in which the developer receiving opening 11*a* moves to and away from the discharge opening 3*a*4, that is, in the direction crossing with a mounting and demounting direction of the developer supply container (more specifically, the vertical direction relative to the developer receiving apparatus 8) in this example.

As shown in part (c) of FIG. 4, the developer receiving portion 11 is provided with a main assembly seal 13 having a developer receiving opening 11*a* at the central portion thereof. The main assembly seal 13 is made of an elastic member, a foam member or the like, and is close-contacted with an opening seal 3*a*5 (part (b) of FIG. 7) having a discharge opening 3*a*4 of the developer supply container 1, by which the developer discharged through the discharge opening 3*a*4 is prevented from leaking out of a developer feeding path including developer receiving opening 11*a*.

In order to prevent the contamination in the mounting portion 8*f* by the developer as much as possible, a diameter of the developer receiving opening 11*a* is desirably substantially the same as or slightly larger than a diameter of the discharge opening 3*a*4 of the developer supply container 1. This is because if the diameter of the developer receiving opening 11*a* is smaller than the diameter of the discharge opening 3*a*4, the developer discharged from the developer supply container 1 is easily deposited on the upper surface of the main assembly seal 13 having the developer receiving opening 11*a*. The deposited developer is transferred onto the lower surface of the developer supply container 1 during the dismounting operation of the developer supply container 1, with the result of contamination with the developer. In addition, the developer transferred onto the developer supply container 1 may be scattered to the mounting portion 8*f* with the result of contamination of the mounting portion 8*f* with the developer.

On the contrary, if the diameter of the developer receiving opening 11*a* is quite larger than the diameter of the discharge opening 3*a*4, an area in which the developer scattered from the developer receiving opening 11*a* is deposited around the discharge opening 3*a*4 formed in the opening seal 3*a*5 is large. That is, the contaminated area of the developer supply container 1 by the developer is large, which is not preferable. Under the circumstances, the difference between the diameter of the developer receiving opening 11*a* and the diameter of the discharge opening 3*a*4 is preferably substantially 0 to approx. 2 mm. In this example, the diameter of the discharge opening 3*a*4 of the developer supply container 1 is approx. Φ2 mm (pin hole), and therefore, the diameter of the developer receiving opening 11*a* is approx. ϕ3 mm.

Furthermore, as shown in part (b) of FIG. 3, the developer receiving portion 11 is urged by an urging member 12 in the direction such that the developer receiving opening 11*a* tends to be away from the discharge opening 3*a*4 (more specifically, downward). In other words, when the developer receiving opening 11*a* moves toward the discharge opening 3*a*4 (more specifically, upward), the developer receiving portion 11 moves against an urging force of the urging member 12.

As shown in part (b) of FIG. 3, below the developer receiving apparatus 8, there is provided a sub-hopper 8*c* for temporarily storing the developer. In the sub-hopper 8*c*, there are provided a feeding screw 14 for feeding the developer into the developer hopper portion 201*a* which is a part of the developing device 201, and an opening 8*d* which is in fluid communication with the developer hopper portion 201*a*.

Figure 13:
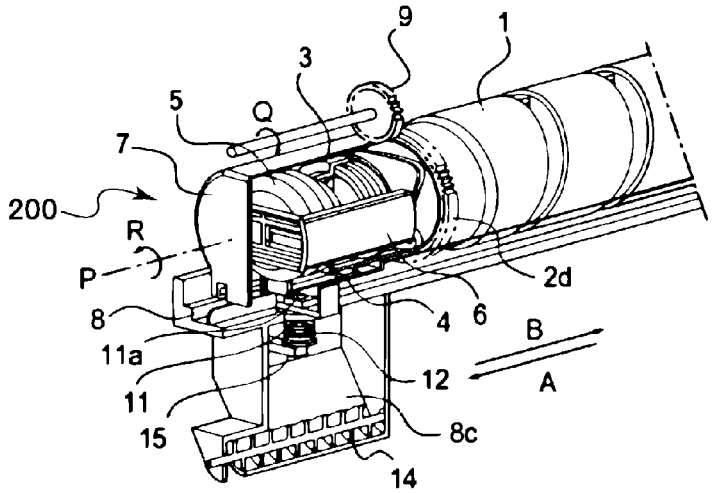
FIG. 13 is a partially sectional perspective view (a), a partially sectional front view (b) and a top plan view (c) of a developer supplying apparatus showing a first step of a mounting and demounting operation of the developer supply container, and an illustration of a relationship (d) between the lower flange portion and the developer receiving portion.
Figure 13:
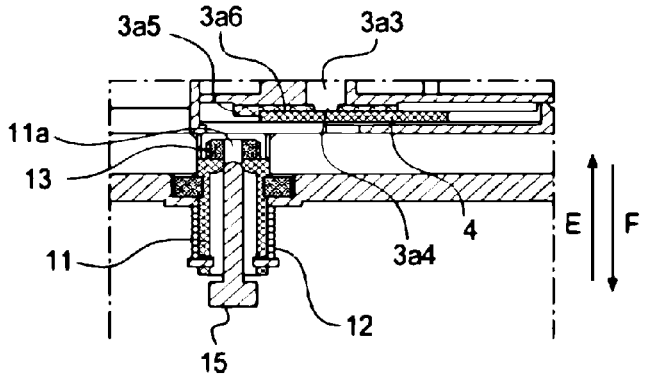
Figure 13:
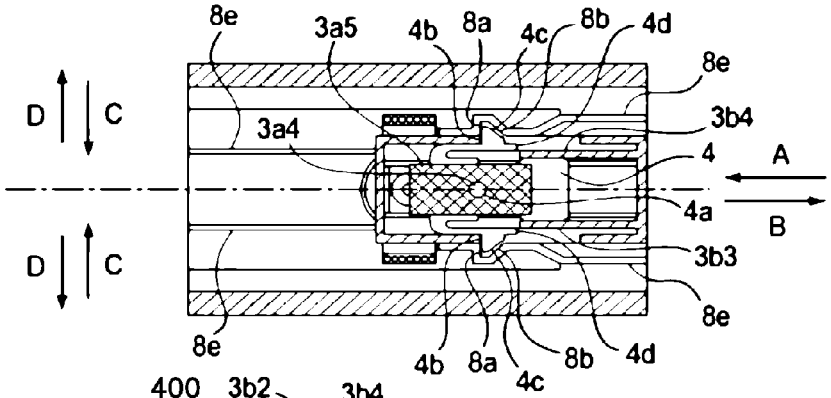
Figure 13:
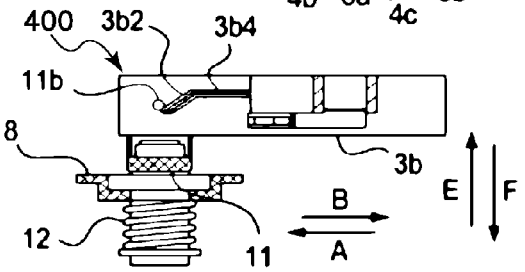

As shown in part (b) of FIG. 13, the developer receiving opening 11*a* is closed so as to prevent foreign matter and/or dust entering the sub-hopper 8*c* in a state that the developer supply container 1 is not mounted. More specifically, the developer receiving opening 11*a* is closed by a main assembly shutter 15 in the state that the developer receiving portion 11 is away to the upside. The developer receiving portion 11 moves upwardly (arrow E) from the position shown in part (b) of FIG. 13 toward the developer supply container 1. By this, as shown in part (b) of FIG. 15, the developer receiving opening 11*a* and the main assembly shutter 15 are spaced from each other so that the developer receiving opening 11*a* is open. With this open state, the developer is discharged from the developer supply container 1 through the discharge opening 3*a*4, so that the developer received by the developer receiving opening 11*a* is movable to the sub-hopper 8*c*.

As shown in part (c) of FIG. 4, a side surface of the developer receiving portion 11 is provided with an engaging portion 11*b* constituting a receiving portion moving mechanism 400 as a receiving portion moving means which will be described hereinafter. The engaging portion 11*b* is directly engaged with guide portions 3*b*2, 3*b*4 (FIG. 8) provided on the developer supply container 1 which will be described hereinafter, and is guided thereby so that the developer receiving portion 11 is raised toward the developer supply container 1. The positional relation between the engaging portion 11*b* and the guide portions 3*b*2, 3*b*4 may be opposite. It will suffice if one of the developer supply container 1 and the developer receiving portion 11 is provided with the engaging portion, and the other is provided with the guide portion such that in the mounting and demounting operation of the developer supply container 1, the developer receiving portion 11 he is moved by the engagement between the engaging portion and the guide portion.

As shown in part (a) of FIG. 3, the mounting portion 8*f* of the developer receiving apparatus 8 is provided with an insertion guide 8*e* for guiding the developer supply container 1 in the mounting and demounting direction. By the insertion guide 8*e*, the mounting direction of the developer supply container 1 is made along the arrow A. The dismounting direction of the developer supply container 1 is the opposite (arrow B) to the direction of the arrow A.

As shown in part (a) of FIG. 3, the developer receiving apparatus 8 is provided with a driving gear 9 functioning as a driving mechanism for driving the developer supply container 1. The driving gear 9 receives a rotational force from a driving motor 500 through a driving gear train, and functions to apply a rotational force to the developer supply container 1 which is set in the mounting portion 8*f*. As shown in FIGS. 3 and 4, the driving motor 500 is controlled by a control device (CPU) 600.

[Developer Supply Container]

Figure 5:
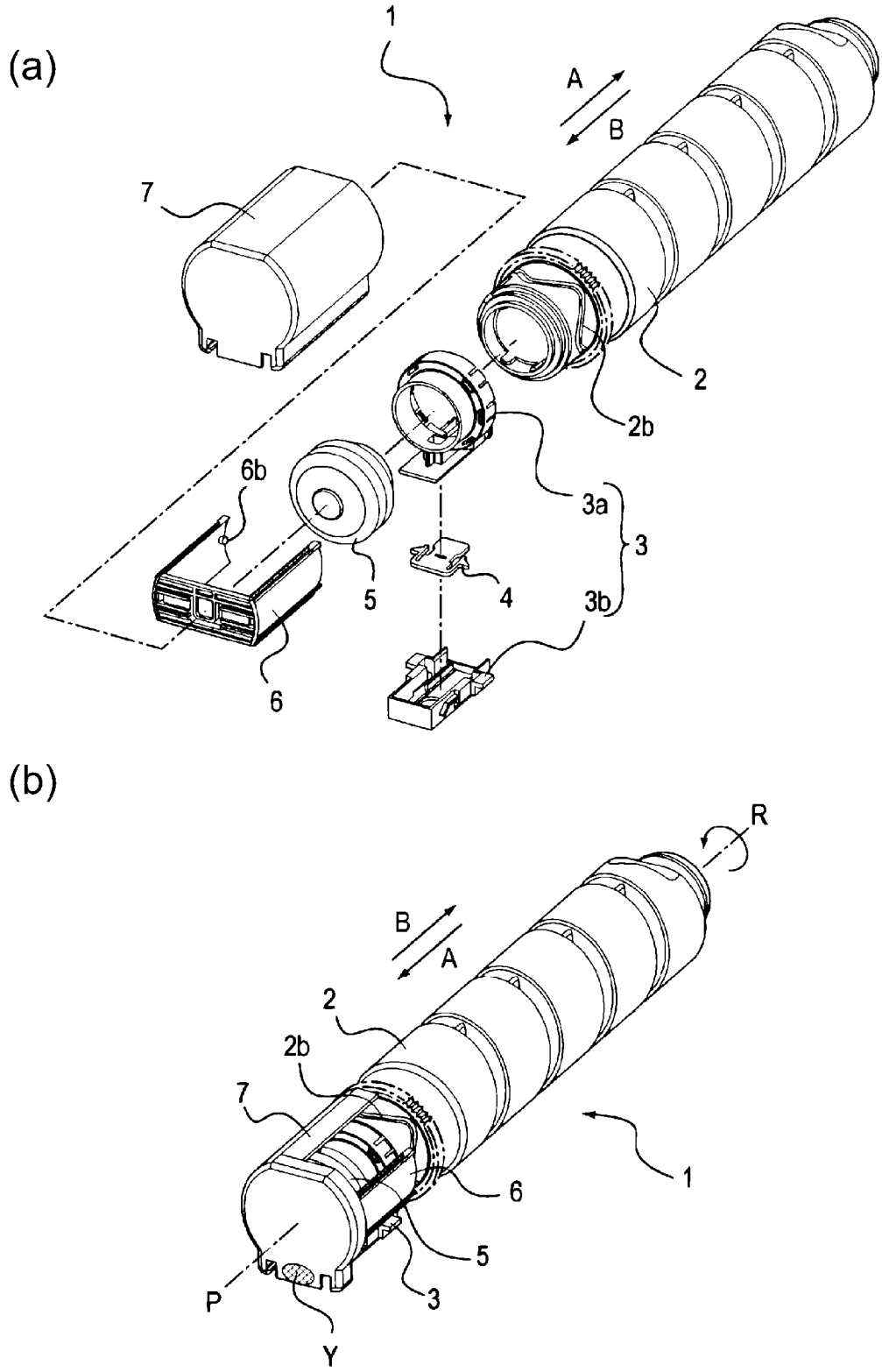
FIG. 5 is an exploded perspective view (a) and a perspective view (b) of the developer supply container.

FIG. 5 to FIG. 12, the developer supply container 1 of the developer supplying apparatus 200 will be described. Referring to FIG. 5, a general arrangement of the developer supply container 1 will be described. As shown in part (a) of FIG. 5, the developer supply container 1 is detachably mountable to the main assembly 100*a*, and mainly comprises a container body 2, a flange portion 3, a shutter 4, a pump portion 5, a reciprocating member 6 and the cover 7. The developer supply container 1 is rotated about a rotational axis P shown in part (b) of FIG. 5 in a direction of an arrow R in the developer receiving apparatus 8, by which the developer is supplied into the developer receiving apparatus 8. Each element of the developer supply container 1 will be described in detail.

[Container Body]

Figure 6:
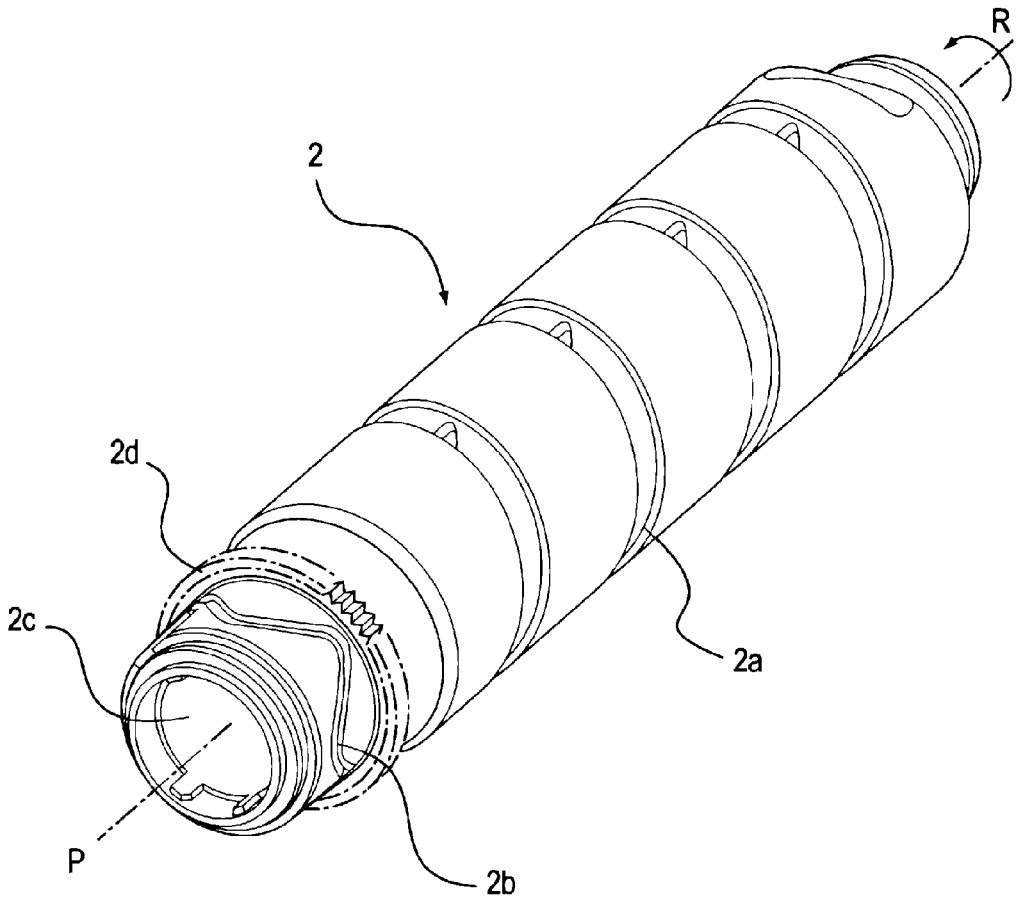
FIG. 6 is a perspective view of a container body.

As shown in FIG. 6, the container body (developer feeding chamber) 2 mainly comprises a developer accommodating portion 2*c* for accommodating the developer. The container body 2 further comprises a helical feeding groove 2*a* (feeding portion) for feeding the developer in the developer accommodating portion 2*c* by rotation of the container body 2 about a rotational axis P in the direction of the arrow R. As shown in FIG. 6, a cam groove 2*b* and drive receiving portion (drive inputting portion) for receiving the drive from the main assembly side are formed integrally with the body 2, over the full circumference at one end portion of the container body 2. In this example, the cam groove 2*b* and the drive receiving portion 2*d* are integrally formed with the container body 2, but the cam groove 2*b* or the drive receiving portion 2*d* may be formed as another member, and may be mounted to the container body 2. In this example, the developer containing the toner having a volume average particle size of 5 μm-6 μm is accommodated in the developer accommodating portion 2*c* of the container body 2. In this example, the developer accommodating portion (developer accommodating space) 2*c* is provided not only by the container body 2 but also by the inside space of the flange portion 3 and the pump portion 5.

[Flange Portion]

Figure 7:
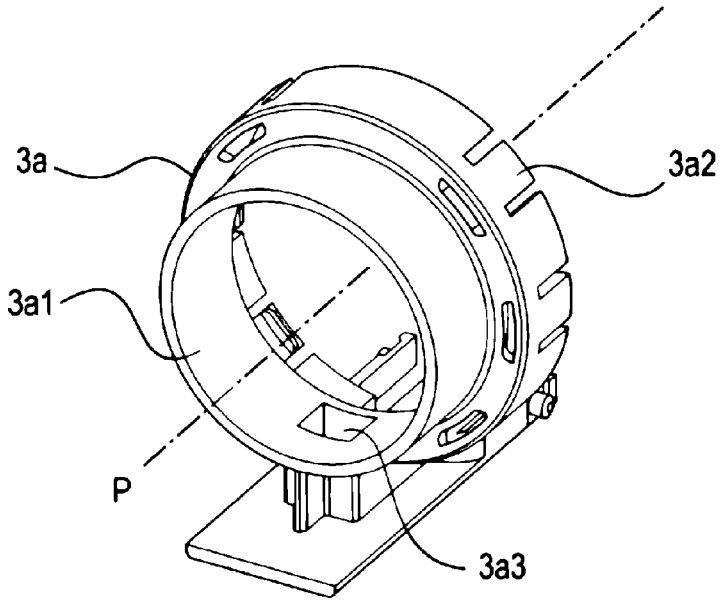
FIG. 7 is a perspective view (a), similar to FIG. 5, of an upper flange portion, and a perspective view (b) thereof as seen from a lower side of FIG. 5.
Figure 7:
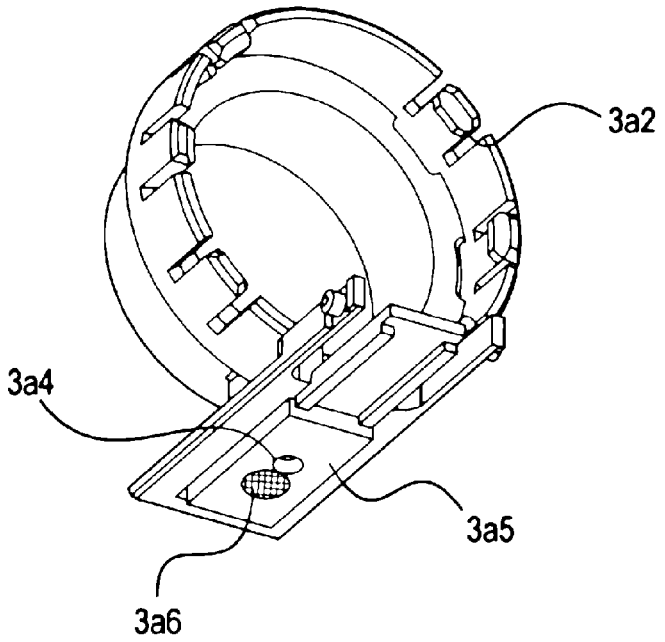
Figure 8:
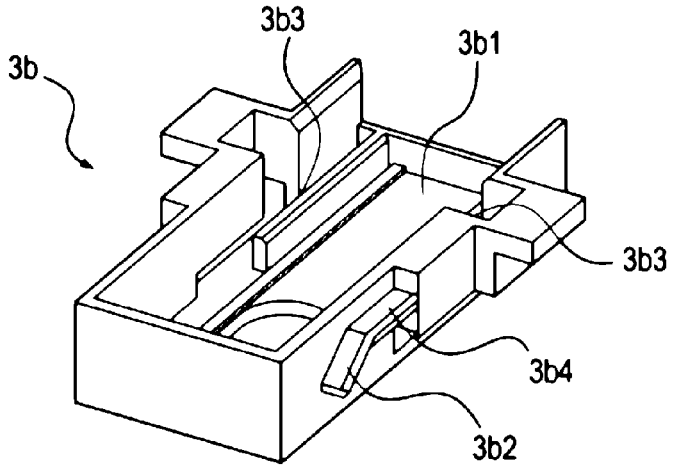
FIG. 8 is a perspective view (a), similar to FIG. 5, of a lower flange portion, a perspective view (b) thereof as seen from the lower side of FIG. 5 and a front view (c).
Figure 8:
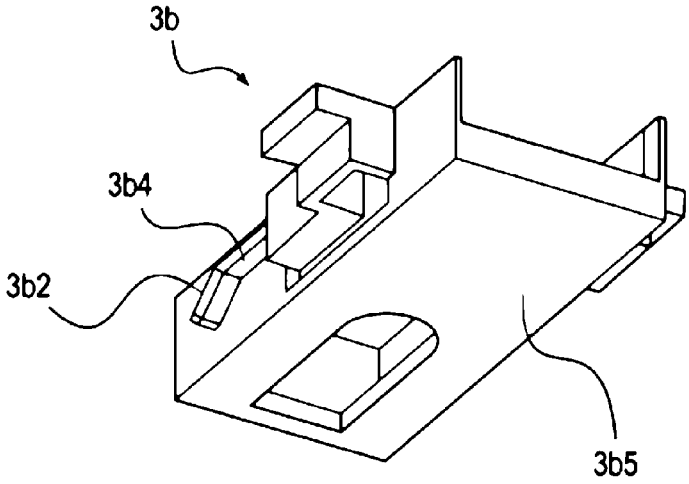
Figure 8:
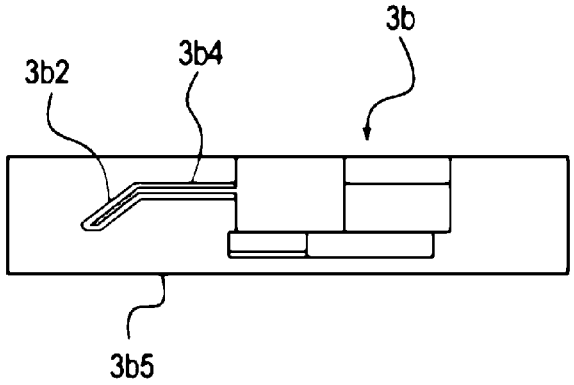

Referring to FIGS. 5, 7 and 8, the flange portion 3 will be described. As shown in part (b) of FIG. 5, the flange portion (developer discharging chamber) 3 is rotatable relative to the container body 2 about the axis P. When the developer supply container 1 is mounted to the developer receiving apparatus 8, it is not rotatable in the direction of the arrow R relative to the mounting portion 8*f* (part (a) of FIG. 3). In addition, it is provided with the discharge opening 3*a*4 (FIG. 7). As shown in part (a) of FIG. 5, the flange portion 3 is divided into an upper flange portion 3*a*, a lower flange portion 3*b* taking into account an assembling property, and the pump portion 5, the reciprocating member 6, the shutter 4 and the cover 7 are mounted thereto.

As shown in part (a) of FIG. 5, the pump portion 5 is connected with one end portion side of-the upper flange portion 3*a* by screws, and the container body 2 is connected with the other end portion side through a sealing member (unshown). The pump portion 5 is sandwiched between the reciprocating members 6, and engaging projections 6*b* (FIG. 11) of the reciprocating member 6 are fitted in the cam groove 2*b* of the container body 2. Furthermore, the shutter 4 is inserted into a gap between the upper flange portion 3*a* and the lower flange portion 3*b*. For protection of the reciprocating member 6 and the pump portion 5 and for better outer appearance, the cover 7 is integrally provided so as to cover the entirety of the flange portion 3, the pump portion 5 and the reciprocating member 6.

[Upper Flange Portion]

Referring to FIG. 7, the upper flange portion 3*a* will be described. The upper flange portion 3*a* includes a pump connecting portion 3*a*1 (screw is not shown) to which the pump portion 5 is threaded, a container body connecting portion 3*a*2 shown in part (b) of FIG. 7 to which the container body 2 is connected, and a storage portion 3*a*2 for storing the developer fed from the container body 2. As shown in part (b) of FIG. 7, there are provided a circular discharge opening (opening) 3*a*4 for permitting discharging of the developer into the developer receiving apparatus 8 from the storage portion 3*a*3, and an opening seal 3*a*5 forming a connecting portion 3*a*6 connecting with the developer receiving portion 11 which will be described hereinafter. The opening seal 3*a*5 is stuck on the bottom surface of the upper flange portion 35*a* by a double coated tape and is nipped by shutter 4 which will be described hereinafter and the flange portion 3*a* to prevent leakage of the developer through the discharge opening 3*a*4. In this example, the discharge opening 3*a*4 is provided to opening seal 3*a*5 which is unintegral with the flange portion 3*a*, but the discharge opening 3*a*4 may be provided directly in the upper flange portion 35*a*.

As described above, the diameter of the discharge opening 3*a*4 is approx. 2 mm for the purpose of minimizing the contamination with the developer which may be unintentionally discharged by the opening and closing of the shutter 4 in the mounting and demounting operation of the developer supply container 1 relative to the developer receiving apparatus 8. In this example, the discharge opening 3*a*4 is provided in the lower surface of the developer supply container 1, that is, the lower surface of the upper flange portion 3*a*. However, the connecting structure of this example can be accomplished if it is fundamentally provided in a side except for a upstream side end surface or a downstream side end surface with respect to the mounting and dismounting direction of the developer supply container 1 relative to the developer receiving apparatus 8. The position of the discharge opening 25*a*4 may be properly selected taking situation of the specific apparatus into account. A connecting operation between the developer supply container 1 and the developer receiving apparatus 8 in this example will be described hereinafter.

[Lower Flange Portion]

Figure 18:
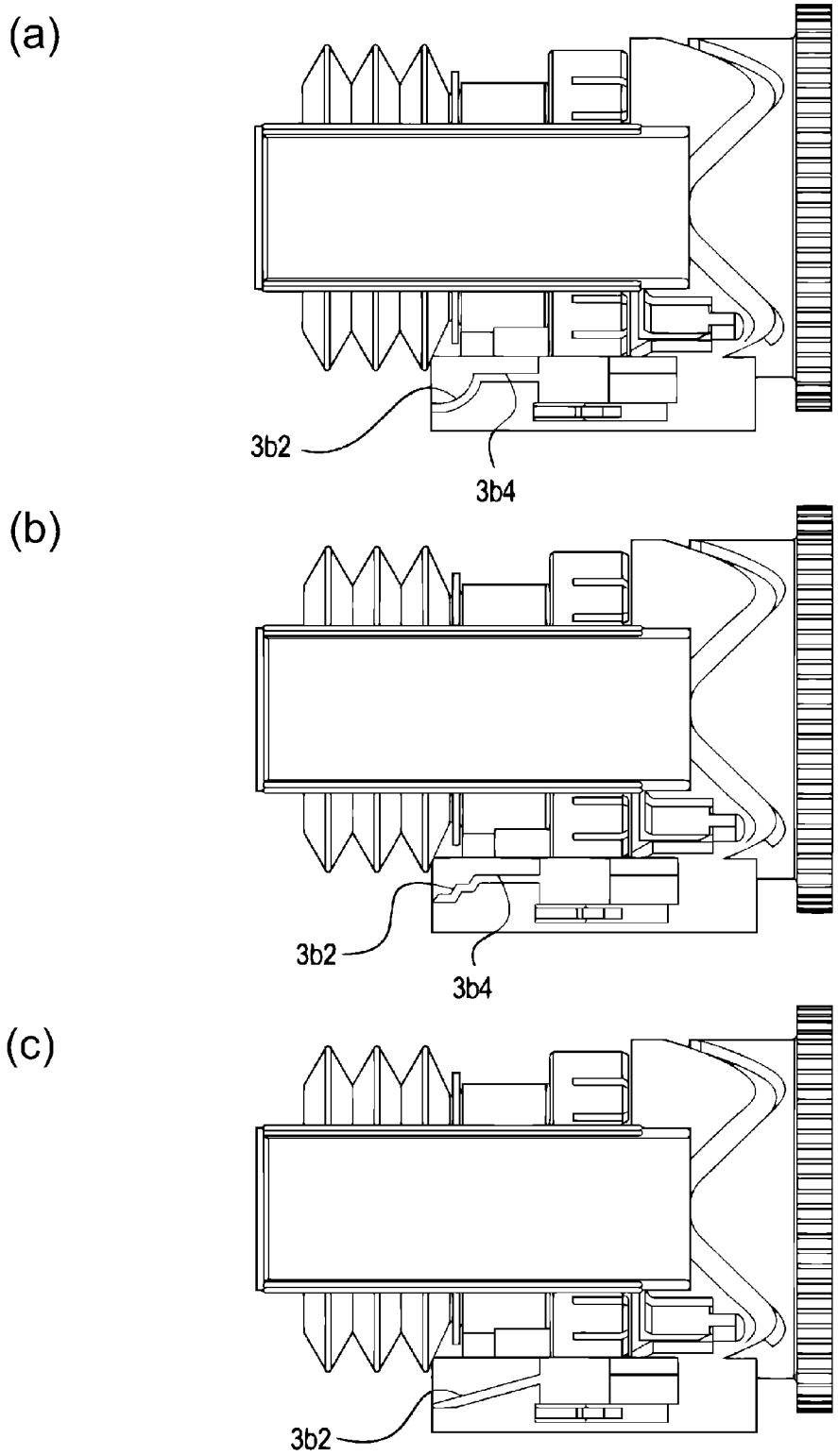
FIGS. 18(*a*), (*b*) and (*c*) illustrate three modified examples of the guide portion of the developer supply container.

Referring to FIGS. 8 and 18, the lower flange 3*b* will be described. As shown in part (a) of FIG. 8, the lower flange portion 3*b* is provided with a shutter inserting portion 3*b*1 into which the shutter (FIG. 9) is inserted. The lower flange 3*b* constitutes the receiving portion moving mechanism 400 which will be described hereinafter, and is provided with guide portions 3*b*2, 3*b*4 engageable with the engaging portion 11*b* of the developer receiving portion 11 (FIG. 4).

The guiding portions 3*b*2, 3*b*4 displace the developer receiving portion 11 toward the developer supply container 1 with the mounting operation of the developer supply container 1 so that the connected state is established in which the developer supply from the developer supply container 1 to the developer receiving portion 11 is enabled. The guiding portions 3*b*2, 3*b*4 guide the developer receiving portion 11 to space away from the developer supply container 1 so that the connection between the developer supply container 1 and the developer receiving portion 39 is broken with the dismounting operation of the developer supply container1.

A first guiding portion 3*b*2 of the guiding portions 3*b*2, 3*b*4 displaces the developer receiving portion 11 in the direction crossing with the mounting direction of the developer supply container 1 for permitting an unsealing operation of the developer receiving portion 1. In this example, the first guiding portion 3*b*2 displaces the developer receiving portion 11 toward the developer supply container 1 so that the developer receiving portion 11 is connected with the connecting portion 3*a*6 formed in a part of the opening seal 3*a*5 with the mounting operation of the developer supply container 1. The first guiding portion 3*b*2 extends in the direction inclining relative to the mounting direction of the developer supply container 1.

The first guiding portion 3*b*2 effects a guiding operation so as to displace the developer receiving portion 11 in the direction crossing with the dismounting direction of the developer supply container 1 such that the developer receiving portion 11 is resealed with the dismounting operation of the developer supply container 1. In this example, the first guiding portion 3*b*2 effects the guiding so that the developer receiving portion 11 is spaced away from the developer supply container 1 downwardly, so that the connection state between the developer receiving portion 11 and the connecting portion 3*a*6 is broken with the dismounting operation of the developer supply container 1.

On the other hand, a second engaging portion 3*b*4 maintains the connection stated between the opening seal 3*a*5 and a main assembly seal 13, so that the discharge opening 3*a*4 is brought into communication with a developer receiving opening 11*a* of the developer receiving portion 11, with the mounting operation of the developer supply container 1. During the developer supply container 1 moving relative to the shutter 4 which will be described hereinafter, that is, during the developer receiving opening 11*a* moving from the connecting portion 3*a*6 to the discharge opening 3*a*4, the connection between the main assembly seal 13 and the opening seal 3*a*5 is maintained. Such a second guide portion 3*b*4 extends in a direction parallel with the mounting direction of the developer supply container 1.

The second engaging portion 3*b*4 maintains the connection between the main assembly seal 13 and the opening seal 3*a*5 so that the discharge opening 3*a*4 is resealed, with the dismounting operation of the developer supply container 1. During the developer supply container 1 moving relative to the shutter 4, that is, during the developer receiving opening 11*a* moving from the discharge opening 3*a*4 to the connecting portion 3*a*6, the connection between the main assembly seal 13 and the opening seal 3*a*5 is maintained.

The configuration of the first guide portion 3*b*2 is not limited to a linear inclined surface as shown in part (a) of FIG. 8. The configuration of the first guide portion 3*b*2 may be curved as shown in part (a) of FIG. 18, for example. Furthermore, it may be steps-like as shown in part (b) of FIG. 18. The configuration of the first engaging portion 3*b*2 is not limited to the configuration shown in parts (a) or (b) of FIGS. 8 and 18, if it can displace the developer receiving portion 11 toward the discharge opening 3*a*4. However, a linear inclined surface is desirable from the standpoint of constant manipulating force required by the mounting and dismounting operation of the developer supply container 1. An inclination angle of the first guiding portion 3*b*2 relative to the mounting and dismounting direction of the developer supply container 1 is desirably approx. 10-50 degrees in view of the situation which will be described hereinafter. In this example, the angle is approx. 40 degrees. In addition, as shown in part (c) of FIG. 18, the first guiding portion 3*b*2 and the second guiding portion 3*b*4 may be unified to provide a uniformly linear inclined surface. In this case, with the mounting operation of the developer supply container 1, the first guiding portion 3*b*2 displaces the developer receiving portion to connect the main assembly seal 13 with the connecting portion 3*a*6 developer receiving portion 11 in the direction crossing with the mounting direction of the developer supply container 1. Thereafter, it displaces the developer receiving portion 11 while compressing the main assembly seal 13 and the opening seal 3*a*5, until the developer receiving opening 11*a* and the discharge opening 3*a*4 are brought into fluid communication with each other.

Here, when such a first guiding portion 3*b*2 shown in part (c) of FIG. 18 is used, the developer supply container 1 always receives a force in the direction of B (part (a) of FIG. 16) in the completed position of the mounting of the developer supply container 1 which will be described hereinafter. Therefore, the developer receiving apparatus 8 is required to have a holding mechanism for holding the developer supply container 1 in the mounting completed position, with the result of increase in cost and/or increase in the number of parts. Therefore, this standpoint, it is preferable that the developer supply container 1 is provided with the above-described second engaging portion 3*b*4 so that the force in the B direction is not applied to the developer supply container 1 in the mounting completed position. By this, the connection state is stably maintained between the main assembly seal 13 and the opening seal 3*a*5.

The first guiding portion 3*b*2 shown in part (c) of FIG. 18 has a linear inclined surface, but similar to the part (a) of FIG. 18 or part (b) of FIG. 18, for example, a curved or stepped configuration is usable. However, the linear inclined surface is preferable from the standpoint of constant manipulating force in the mounting and dismounting operations of the developer supply container 1, as described hereinbefore.

The lower flange portion 3*b* is provided with a regulation rib (regulating portion) 3*b*3 (part (a) of FIG. 3) for preventing or permitting an elastic deformation of a supporting portion 4*d* of the shutter 4 which will be described hereinafter, with the mounting or dismounting operation of the developer supply container 1 relative to the developer receiving apparatus 8. The regulation rib 3*b*3 protrudes upwardly from an insertion surface of the shutter inserting portion 3*b*1 and extends along the mounting direction of the developer supply container 1. In addition, as shown in part (b) of FIG. 8, the protecting portion 3*b*5 is provided to protect the shutter 4 from damage during transportation and/or mishandling of the operator. The lower flange portion 3*b* is integral with the upper flange portion 3*a* in the state that the shutter 4 is inserted in the shutter inserting portion 3*b*1.

[Shutter]

Figure 9:
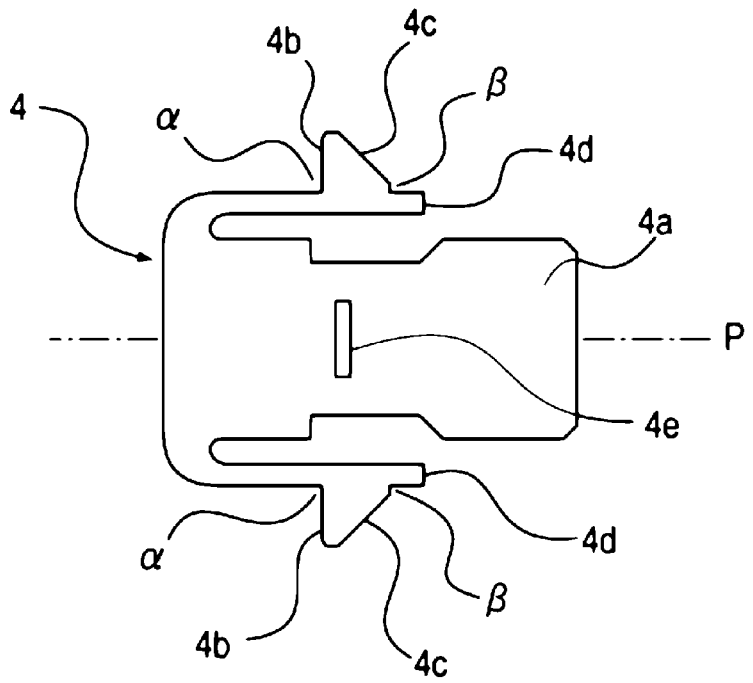
FIG. 9 is a top plan view (a) and a perspective view (b) of a shutter.
Figure 9:
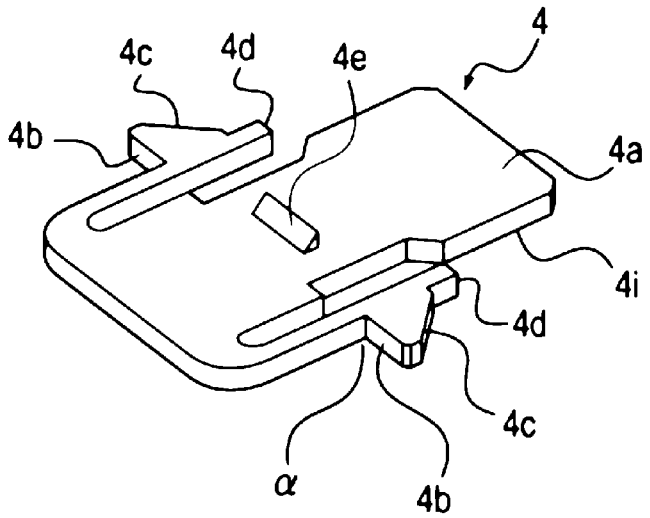

Referring to FIG. 9, the shutter 4 will be described. The shutter 4 is movable relative to the developer supply container 1 to open and close the discharge opening 3*a*4 with the mounting operation and the dismounting operation of the developer supply container 1. The shutter 4 is provided with a developer sealing portion 4*a* and a sliding surface 4*i*. The developer sealing portion 4*a* prevents leakage of the developer through the discharge opening 3*a*4 when the developer supply container 1 is not mounted to the mounting portion 8*f* of the developer receiving apparatus 8. The sliding surface 4*i* is provided on a rear side of the developer sealing portion 4*a*, and slides on the shutter inserting portion 3*b*1 of the lower flange 3*b*.

The shutter 4 is provided with a stopper portion (holding portion) 4*b*, 4*c* held by shutter stopper portions 8*n*, 8*p* (part (a) of FIG. 4) of the developer receiving apparatus 8 with the mounting and dismounting operations of the developer supply container 1 so that the developer supply container 1 moves relative to the shutter 4. A first stopper portion 5*b* of the stopper portions 4*b*, 4*c* engages with a first shutter stopper portion 8*n* of the developer receiving apparatus 8 to fix the position of the shutter 4 relative to the developer receiving apparatus 8 at the time of mounting operation of the developer supply container 1. A second stopper portion 4*c* engages with a second shutter stopper portion 8*b* of the developer receiving apparatus 8 at the time of the dismounting operation of the developer supply container 1.

The shutter 4 is provided with a supporting portion 4*d* so that the stopper portions 4*b*, 4*c* are displaceable. The supporting portion 4*d* extends from the developer sealing portion 4*a* and is elastically deformable to displaceably support the first stopper portion 4*b* and the second stopper portion 4*c*. The first stopper portion 4*b* is inclined such that an angle α formed between the first stopper portion 4*b* and the supporting portion 4*d* is acute. On the contrary, the second stopper portion 4*c* is inclined such that an angle β formed between the second stopper portion 4*c* and the supporting portion 4*d* is obtuse.

The developer sealing portion 4*a* of the shutter 4 is provided with a locking projection 4*e* at a position downstream of the position opposing the discharge opening 3*a*4 with respect to the mounting direction when the developer supply container 1 is not mounted to the mounting portion 8*f* of the developer receiving apparatus 8. A contact amount of the locking projection 4*e* relative to the opening seal 3*a*5 (part (b) of FIG. 7) is larger than relative to the developer sealing portion 4*a* so that a static friction force between the shutter 4 and the opening seal 3*a*5 is large. Therefore, an unexpected movement (displacement) of the shutter 4 due to a vibration during the transportation or the like can be prevented. The entirety of the developer sealing portion 4*a* may correspond to the contact amount between the locking projection 4*e* and the opening seal 3*a*5, However, in such a case, the dynamic friction force relative to the opening seal 3*a*5 at the time when the shutter 4 moves is large as compared with the case of the locking projection 4*e* provided. Therefore, a manipulating force required when the developer supply container 1 is mounted to the developer replenishing apparatus 8 is large, which is not preferable from the standpoint of the usability. Therefore, it is desired to provide the locking projection 4*e* in a part as in this example.

[Pump Portion]

Figure 10:
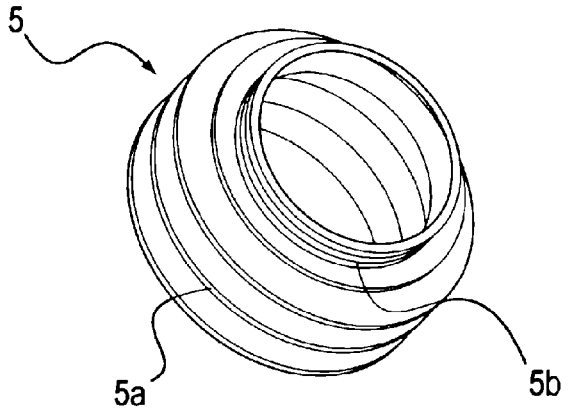
FIG. 10 is a perspective view (a) and a front view (b) of the pump.
Figure 10:
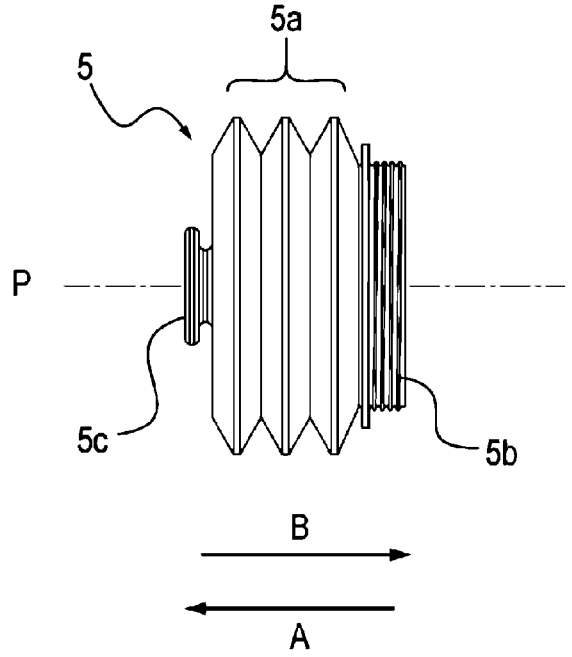

Referring to FIG. 10, the pump portion 5 will be described. The pump portion 5 is operated by the driving force received by the drive receiving portion (drive inputting portion) 2*d* so as to alternately produce a state in which the internal pressure of the developer accommodating portion 2*c* is lower than the ambient pressure and a state in which it is higher than the ambient pressure. In this example, the pump portion 5 is provided as a part of the developer supply container 1 in order to discharge the developer stably from the small discharge opening 3*a*4. The pump portion 5 is a displacement type pump in which the volume changes. More specifically, the pump includes a bellow-like expansion-and-contraction member.

By the expanding-and-contracting operation of the pump portion 5, the pressure in the developer supply container 1 is changed, and the developer is discharged using the pressure. More specifically, when the pump portion 5 is contracted, the inside of the developer supply container 1 is pressurized so that the developer is discharged through the discharge opening 3*a*4. When the pump portion 5 expands, the inside of the developer supply container 1 is depressurized so that the air is taken in through the discharge opening 3*a*4 from the outside. By the take-in air, the developer in the neighborhood of the discharge opening 3*a*4 and/or the storage portion 3*a*3 is loosened so as to make the subsequent discharging smooth. By repeating the expanding-and-contracting operation described above, the developer is discharged.

As shown in part (b) of FIG. 10, the pump portion 5 of this modified example has the bellow-like expansion-and-contraction portion (bellow portion, expansion-and-contraction member) 5*a* in which the crests and bottoms are periodically provided. The expansion-and-contraction portion 5*a* expands and contracts in the directions of arrows A and B. When the bellow-like pump portion 5 as in this example, a variation in the volume change amount relative to the amount of expansion and contraction can be reduced, and therefore, a stable volume change can be accomplished.

In addition, in this example, the material of the pump portion 2 is polypropylene resin material (PP), but this is not inevitable. The material of the pump portion 5 may be any if it can provide the expansion and contraction function and can change the internal pressure of the developer accommodating portion by the volume change. The examples includes thin formed ABS (acrylonitrile, butadiene, styrene copolymer resin material), polystyrene, polyester, polyethylene materials. Alternatively, other expandable-and-contractable materials such as rubber are usable.

In addition, as shown in part (a) of FIG. 10, the opening end side of the pump portion 5 is provided with a connecting portion 5*b* connectable with the upper flange portion 3*a*. Here, the connecting portion 5*b* is a screw. Furthermore, as shown in part (b) of FIG. 10 the other end portion side is provided with a reciprocating member engaging portion 5*c* engaged with the reciprocating member 5 to displace in synchronism with the reciprocating member 6 which will be described hereinafter.

[Reciprocating Member]

Figure 11:
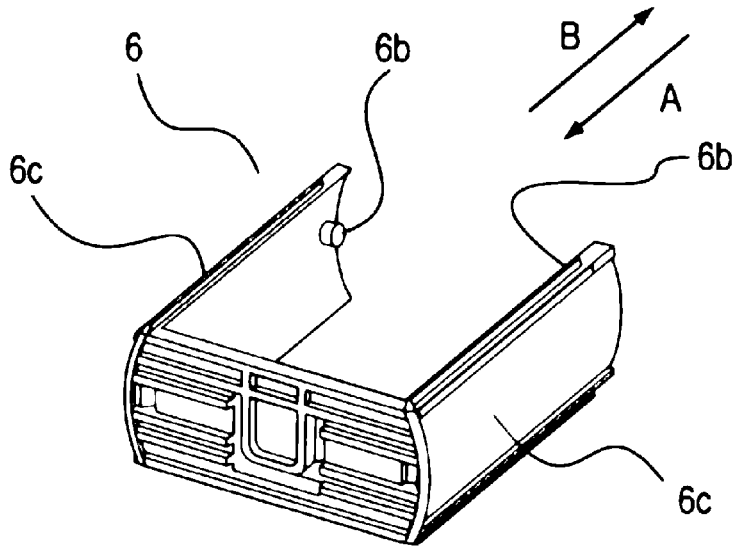
FIG. 11 is a perspective view (a), similar to FIG. 5, of a reciprocating member, and a perspective view (b) thereof as seen from the lower side of FIG. 5.
Figure 11:
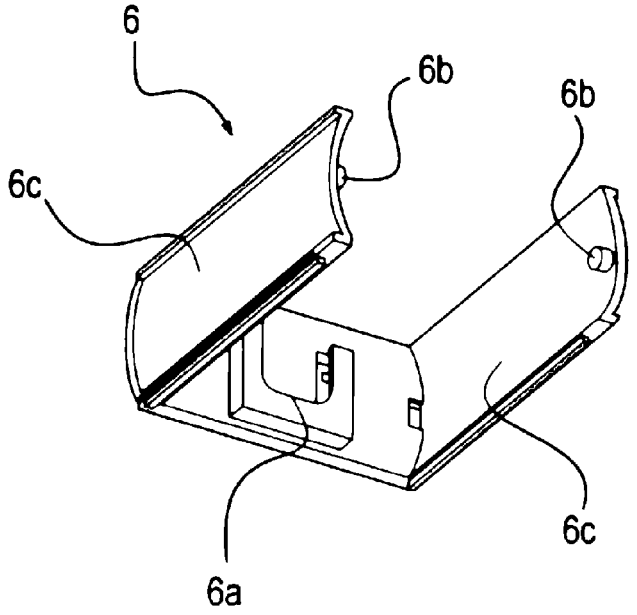

Referring to FIG. 11, the reciprocating member 6 will be described. As shown in part (b) of FIG. 11, the reciprocating member 6 is provided with a pump engaging portion 6*a* engaged with the reciprocating member engaging portion 5*c* provided on the pump portion 5 to change the volume of the pump portion 5 as described above. Furthermore, as shown in part (a) and part (b) of FIG. 11 the reciprocating member 6 is provided with the engaging projection 6*b* fitted in the above-described cam groove 2*b* (FIG. 5) when the container is assembled. The engaging projection 6*b* is provided at a free end portion of the arm 6*c* extending from a neighborhood of the pump engaging portion 6*a*. Rotation displacement of the reciprocating member 6 about the axis P (part (b) of FIG. 5) of the arm 6*c* is prevented by a reciprocating member holding portion 7*b* (FIG. 12) of the cover 7 which will be described hereinafter. Therefore, when the container body 2 receives the drive from the drive receiving portion 2*d* and is rotated integrally with the cam groove 20*n* by the driving gear 9, the reciprocating member 6 reciprocates in the directions of arrows An and B by the function of the engaging projection 6*b* fitted in the cam groove 2*b* and the reciprocating member holding portion 7*b* of the cover 7. Together with this operation, the pump portion 5 engaged through the pump engaging portion 6*a* of the reciprocating member 6 and the reciprocating member engaging portion 5*c* expands and contracts in the directions of arrows An and B.

[Cover]

Figure 12:
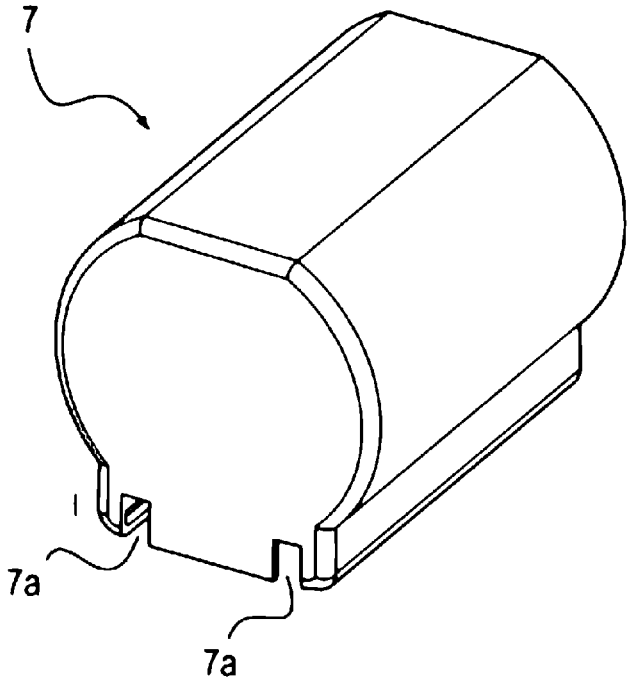
FIG. 12 is a perspective view (a), similarly to FIG. 5, of a cover, and a perspective view (b) as seen from the lower side of FIG. 5.
Figure 12:
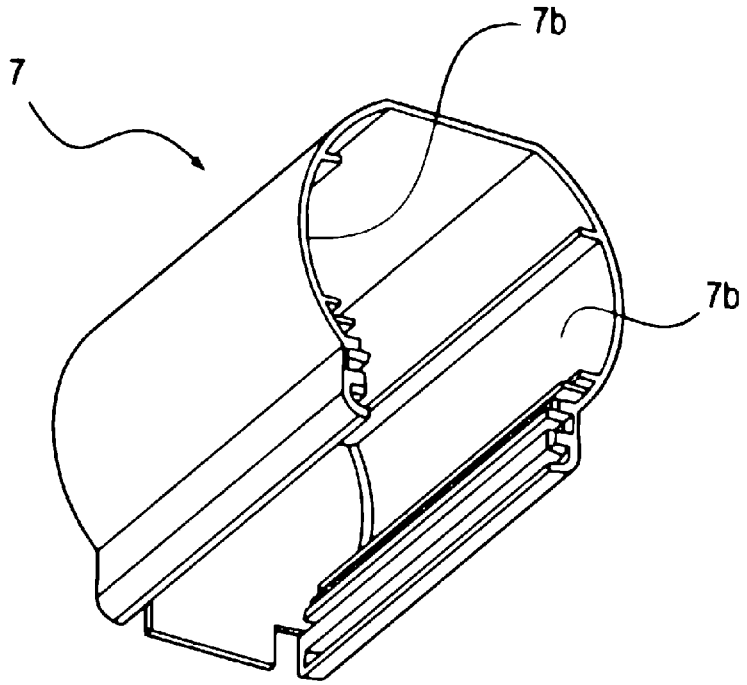

Referring to FIGS. 5 and 12, the cover 7 will be described. The cover 7 is provided as shown in part (b) of FIG. 5 in order to protect the reciprocating member 38 and/or the pump portion 2 and to improve the outer appearance. In more detail, as shown in part (b) of FIG. 5, the cover 7 is provided integrally with the upper flange portion 3*a* and/or the lower flange portion 3*b* and so on by a mechanism (unshown) so as to cover the entirety of the flange portion 3, the pump portion 5 and the reciprocating member 6. In addition, the cover 7 is provided with a guide groove 7*a* to be guided by the insertion guide 8*e* (part (a) of FIG. 3) of the developer receiving apparatus 8. In addition, the cover 7 is provided with a reciprocating member holding portion 7*b* for regulating a rotation displacement about the axis P (part (b) of FIG. 5) of the reciprocating member 6 as described above.

[Mounting Operation of Developer Supply Container]

Referring to FIGS. 13, 14, 15, 16 and 17, the mounting operation of the developer supply container 1 to the developer receiving apparatus 8 will be described in detail. Parts (a)-(c) of FIG. 13-FIG. 16 show the neighborhood of the connecting portion between the developer supply container 1 and the developer receiving apparatus 8. Parts (d) of FIG. 13 to FIG. 16 illustrate particularly the relationship between the lower flange 3*b* and the developer receiving portion 11. The mounting operation is the operation until the developer becomes able to be supplied to the developer receiving apparatus 8 from the developer supply container 1.

FIG. 13 shows a connection starting position (first step) of the developer supply container 1 to the developer receiving apparatus 8. As shown in part (a) of FIG. 13, the developer supply container 1 is inserted into the developer receiving apparatus 8 in the direction indicated by the arrow A. First, as shown in part (c) of FIG. 13, the first stopper portion 4*b* of the shutter 4 contacts the first shutter stopper portion 8*a* of developer receiving apparatus 8, so that the position of the shutter 4 relative to the developer receiving apparatus 8 is fixed. In this state, the relative position between the lower flange portion 3*b* and the upper flange portion 3*a* of the flange portion 3 and the shutter 4 remains unchanged, and therefore, the discharge opening 3*a*4 is sealed assuredly by the developer sealing portion 4*a* of the shutter 4. As shown in part (b) of FIG. 13, the connecting portion 3*a*6 of the opening seal 3*a*5 is shielded by the shutter 4.

As shown in part (c) of FIG. 13, the supporting portion 4*d* of the shutter 4 is displaceable in the direction of arrows C and D, since the regulation rib 3*b*3 of the lower flange portion 3*b* does not enter the supporting portion 4*d*. As has been described above, the first stopper portion 4*b* is inclined such that the angle α (part (a) of FIG. 9) relative to the supporting portion 4*d* is acute, and the first shutter stopper portion 8*a* is also inclined, correspondingly. In this example, the inclination angle α is approx. 80 degrees. Therefore, when the developer supply container 1 is inserted further in the arrow A direction, the first stopper portion 4*b* receives a reaction force in the arrow B direction from the first shutter stopper portion 8*a*, so that the supporting portion 4*d* is displaced in an arrow D direction. That is, the first stopper portion 4*b* of the shutter 4 displaces in the direction of holding the engagement state with the first shutter stopper portion 8*a* of the developer receiving apparatus 8, and therefore, the position of the shutter 4 is held assuredly relative to the developer receiving apparatus 8.

In addition, as shown in part (d) of FIG. 13, the positional relation between the engaging portion 11*b* of the developer receiving portion 11 and the first engaging portion 3*b*2 of the lower flange portion 3*b* is such that they start engagement with each other. Therefore, the developer receiving portion 11 remains in the initial position in which it is spaced from the developer supply container 1. More specifically, as shown in part (b) of FIG. 13, the developer receiving portion 11 is spaced from the connecting portion 3*a*6 formed on a part of the opening seal 3*a*5. As shown in part (b) of FIG. 13, the developer receiving opening 11*a* is in the sealed state by the main assembly shutter 15. In addition, the driving gear 9 of the developer receiving apparatus 8 and the drive receiving portion 2*d* of the developer supply container 1 are not connected with each other, that is, in the non-transmission state.

In this example, the distance between the developer receiving portion 11 and the developer supply container 1 is approx. 2 mm. When the distance is too small, not more than approx. 1.5 mm, for example, the developer deposited on the surface of the main assembly seal 13 provided on the developer receiving portion 11 may be scattered by air flow produced locally by the mounting and dismounting operation of the developer supply container 1. The scattered developer may be deposited on the lower surface of the developer supply container 1. On the other hand, the distance is too large, a stroke required to displace the developer receiving portion 11 from the spacing position to the connected position is large with the result of upsizing of the image forming apparatus. Or, the inclination angle of the first guiding portion 3*b*2 of the lower flange portion 3*b* is steep relative to the mounting and dismounting direction of the developer supply container 1 with the result of increase of the load required to displace the developer receiving portion 11. Therefore, the distance between the developer supply container 1 and the developer receiving portion 11 is properly determined taking the specifications of the main assembly or the like into account. As described above, in this example, the inclination angle of the first guiding portion 3*b*2 relative to the mounting and dismounting direction of the developer supply container 1 is approx. 40 degrees. The same applies to the following embodiments.

Figure 14:
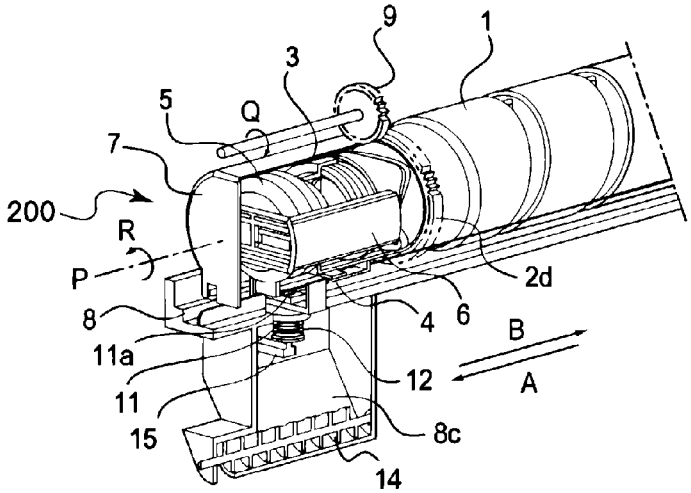
FIG. 14 is a partially sectional perspective view (a), a partially sectional front view (b) and a top plan view (c) of a developer supplying apparatus showing a second step of a mounting and demounting operation of the developer supply container, and a illustration of a relationship (d) between the lower flange portion and the developer receiving portion.
Figure 14:
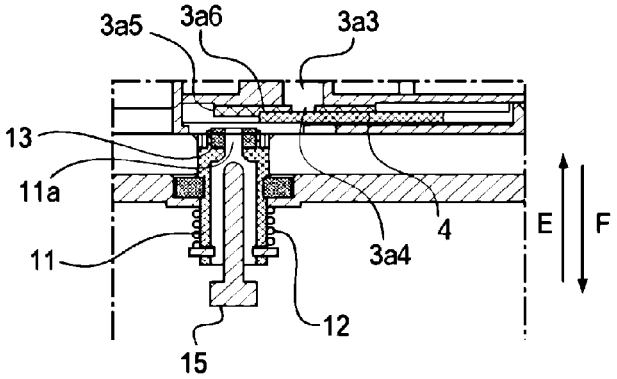
Figure 14:
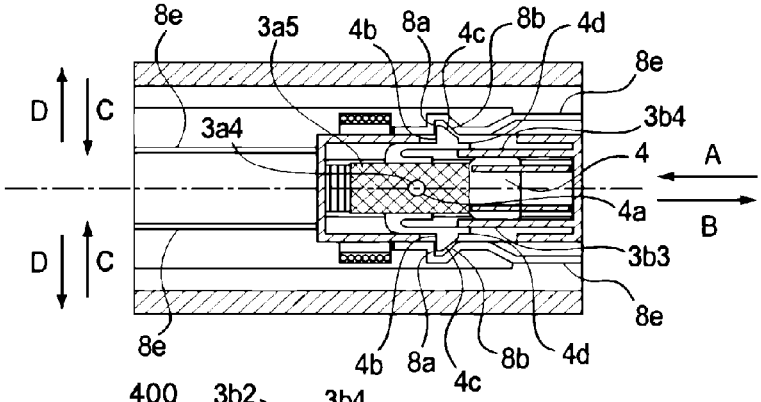
Figure 14:
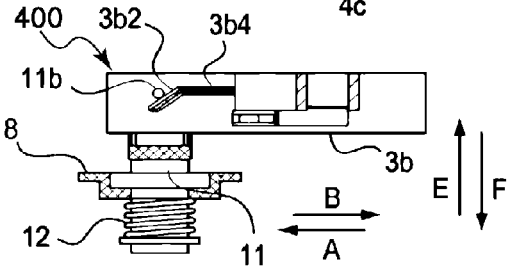

Then, as shown in part (a) of FIG. 14, the developer supply container 1 is further inserted in the direction of the arrow A (second step). As shown in part (c) of FIG. 14, the developer supply container 1 moves relative to the shutter 4 in the direction of the arrow A, since the position of the shutter 4 is held relative to the developer receiving apparatus 8. At this time, as shown in part (b) of FIG. 14, a part of the connecting portion 3*a*6 of the opening seal 3*a*5 is exposed through the shutter 4. Further, as shown in part (d) of FIG. 14, the first guiding portion 3*b*2 of the lower flange portion 3*b* directly engages with the engaging portion 11*b* of the developer receiving portion 11 so that the engaging portion 11*b* is displaced in the direction of the arrow E by the first guiding portion 3*b*2. Therefore, the developer receiving portion 11 is displaced in the direction of the arrow E against the urging force of the urging member 12 (arrow F) to the position shown in part (b) of FIG. 14, so that the developer receiving opening 11*a* is spaced from the main assembly shutter 15, thus starting to unseal. Here, in the position of FIG. 14, the developer receiving opening 11*a* and the connecting portion 3*a*6 are spaced from each other. Further, as shown in part (c) of FIG. 14, the regulation rib 3*b*3 of the lower flange portion 3*b* enters of supporting portion 4*d* of the shutter 4, so that the supporting portion 4*d* can not displace in the direction of arrow C or arrow D. That is, the elastic deformation of the supporting portion 4*d* is limited by the regulation rib 3*b*3.

Figure 15:
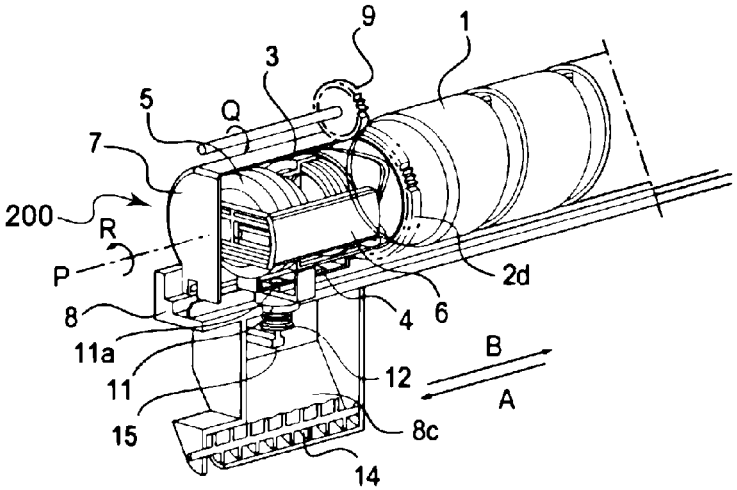
FIG. 15 is a partially sectional perspective view (a), a partially sectional front view (b) and a top plan view (c) of a developer supplying apparatus showing a third step of a mounting and demounting operation of the developer supply container, and a illustration of a relationship (d) between the lower flange portion and the developer receiving portion.
Figure 15:
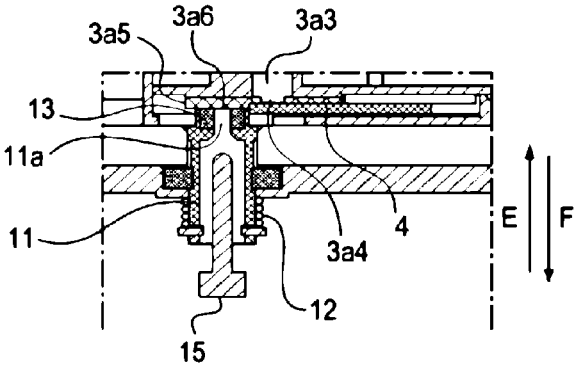
Figure 15:
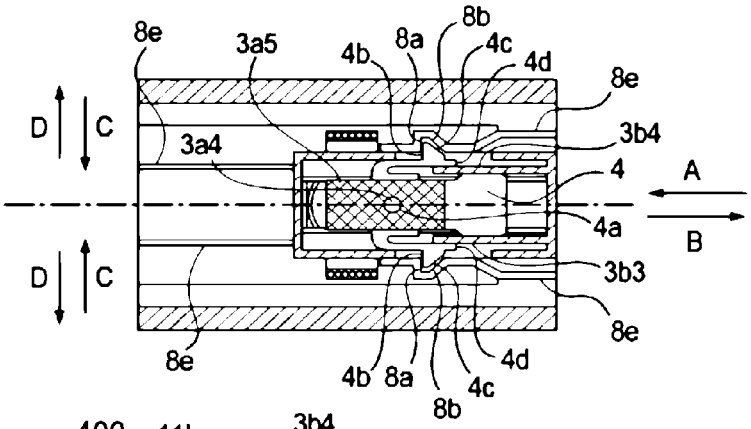
Figure 15:
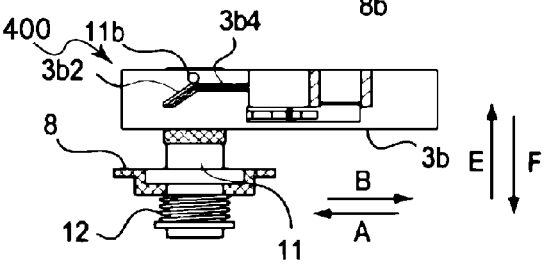

Then, as shown in part (a) of FIG. 15, the developer supply container 1 is further inserted in the direction of the arrow A (third step). Then, as shown in part (c) of FIG. 15, the developer supply container 1 moves relative to the shutter 4 in the direction of the arrow A, since the position of the shutter 4 is held relative to the developer receiving apparatus 8. At this time, the connecting portion 3*a*6 formed on the part of the opening seal 3*a*5 is completely exposed from the shutter 4. In addition, the discharge opening 3*a*4 is not exposed from the shutter 4, so that it is still sealed by the developer sealing portion 4*a*.

Furthermore, as described hereinbefore, the regulation rib 3*b*3 of the lower flange portion 3*b* enters the supporting portion 4*d* of the shutter 4, by which the supporting portion 4*d* can not displace in the direction of arrow C or arrow D. At this time, as shown in part (d) of FIG. 15, the directly engaged guiding portion 11*b* of the developer receiving portion 11 reaches the upper end side of the first engaging portion 3*b*2. The developer receiving portion 11 is displaced in the direction of the arrow E against the urging force (arrow F) of the urging member 12, to the position shown in part (b) of FIG. 15, so that the developer receiving opening 11*a* is completely spaced from the main assembly shutter 15 to be unsealed.

At this time, the connection is established in the state that the main assembly seal 13 having the developer receiving opening 11*a* is close-contacted to the connecting portion 3*a*6 of the opening seal 3*a*5. In other words, by the developer receiving portion 11 directly engaging with the first engaging portion 3*b*2 of the developer supply container 1, the developer supply container 1 can be accessed by the developer receiving portion 11 from the lower side in the vertical direction which is crossed with the mounting direction. Thus, the above-described the structure can avoid the developer contamination at the end surface Y (part (b) of FIG. 5) in the downstream side with respect to the mounting direction of the developer supply container 1, the developer contamination having been produced in the conventional structure in which the developer receiving portion 11 accesses the developer supply container 1 in the mounting direction. The conventional structure will be described hereinafter.

Subsequently, as shown in part (a) of FIG. 16, when the developer supply container 1 is further inserted in the direction of the arrow A to the developer receiving apparatus 8 (fourth step). Then, as shown in part (c) of FIG. 16, the developer supply container 1 moves relative to the shutter 4 in the direction of the arrow A similar to the forgoing, up to a supply position (second position). In this position, the driving gear 9 and the drive receiving portion 2*d* are connected with each other, and by the driving gear 9 rotating in the direction of an arrow Q, the container body 2 is rotated in the direction of the arrow R. As a result, the pump portion 5 is reciprocated by the reciprocation of the reciprocating member 6 in interrelation with the rotation of the container body 2. Therefore, the developer in the developer accommodating portion 2*c* is supplied into the sub-hopper 8*c* from the storage portion 3*a*3 through the discharge opening 3*a*4 and the developer receiving opening 11*a* by the reciprocation of the pump portion 5 described above.

Figure 16:
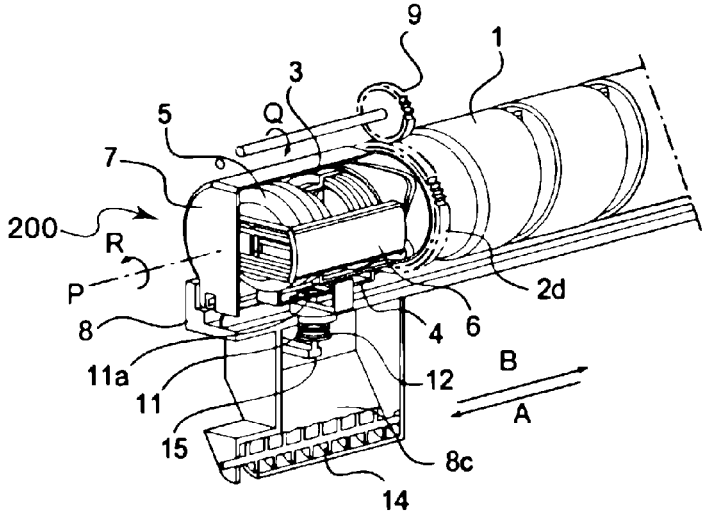
FIG. 16 is a partially sectional perspective view (a), a partially sectional front view (b) and a top plan view (c) of a developer supplying apparatus showing a fourth step of a mounting and demounting operation of the developer supply container, and a illustration of a relationship (d) between the lower flange portion and the developer receiving portion.
Figure 16:
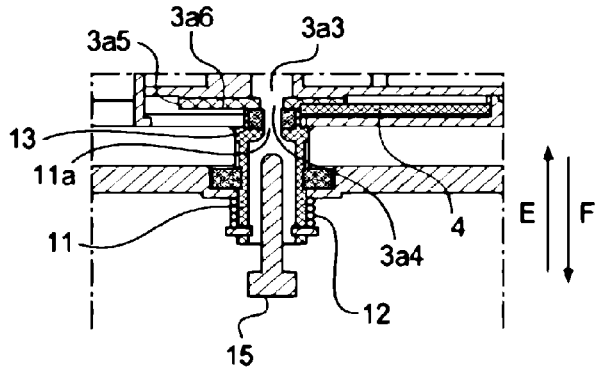
Figure 16:
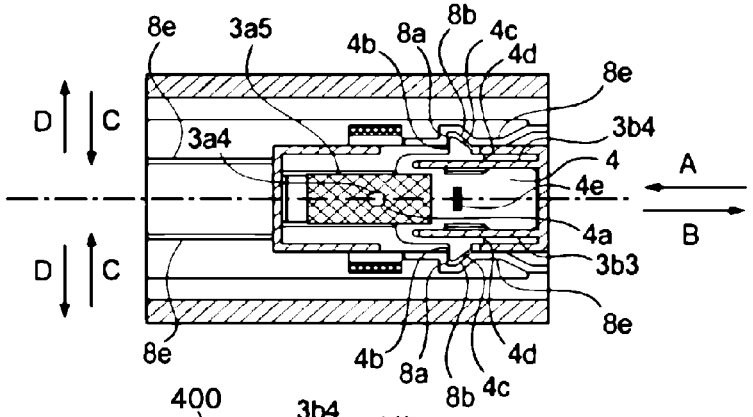
Figure 16:
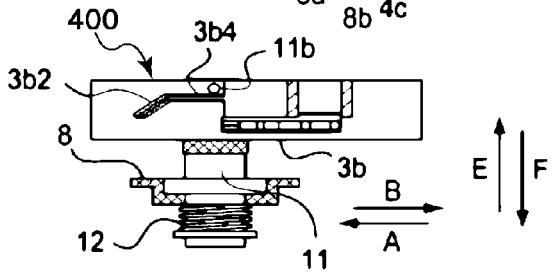
Figure 17:
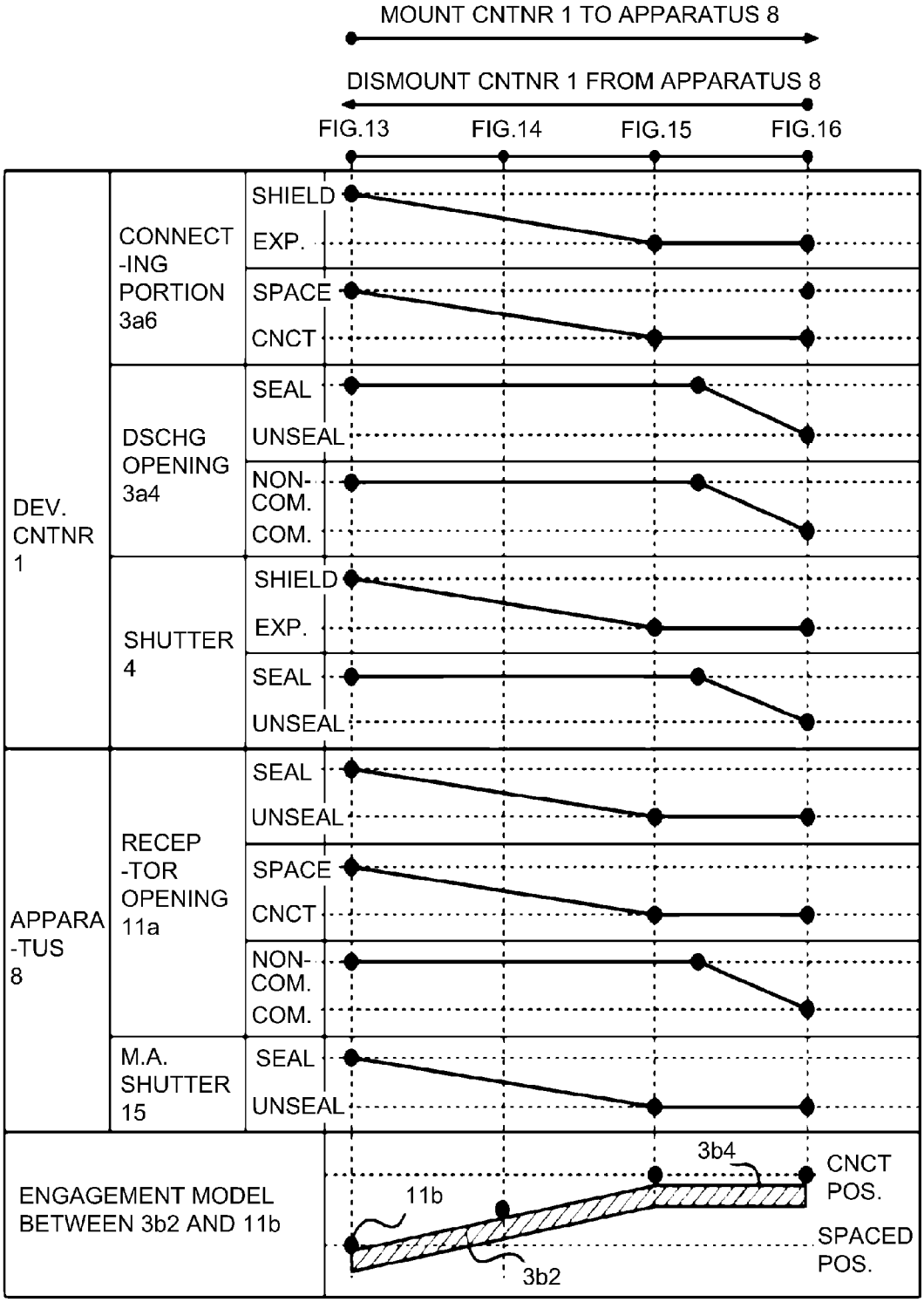
FIG. 17 is a timing chart of the mounting and demounting operation of the developer supply container.

In addition, as shown in part (d) of FIG. 16, when the developer supply container 1 reaches the supply position relative to the developer receiving apparatus 8, the engaging portion 11*b* of the developer receiving portion 11 is engaged with the second guiding portion 3*b*4 by way of the engaging relation with the first engaging portion 3*b*2 of the lower flange portion 3*b*. And, the engaging portion 11*b* is brought into the state of being urged to the second guiding portion 3*b*4 by the urging force of the urging member 12 in the direction of the arrow F. Therefore, the position of the developer receiving portion 11 in the vertical direction is stably maintained. Furthermore, as shown in part (b) of FIG. 16, the discharge opening 3*a*4 is unsealed by the shutter 4, and the discharge opening 3*a*4 and the developer receiving opening 11*a* are brought into fluid communication with each other.

At this time, the developer receiving opening 11*a* slides on the opening seal 3*a*5 to communicate with the discharge opening 3*a*4 while keeping the close-contact state between the main assembly seal 13 and the connecting portion 3*a*6 formed on the opening seal 3*a*5. Therefore, the amount of the developer falling from the discharge opening 3*a*4 and scattering to the position other than the developer receiving opening 11*a* is small. Thus, the contamination of the developer receiving apparatus 8 by the scattering of the developer is less.

[Dismounting Operation of Developer Supply Container]

Referring mainly to FIG. 13-FIGS. 16 and 17, the operation of dismounting of the developer supply container 1 from the developer receiving apparatus 8 will be described. The dismounting operation of the developer supply container 1 is a reciprocal of the above-described mounting operation. Thus, the developer supply container 1 is dismounted from the developer receiving apparatus 8 in the order from FIG. 16 to FIG. 13. The dismounting operation (removing operation) is the operation to the state in which the developer supply container 1 can be take out of the developer receiving apparatus 8.

The amount of the developer in the developer supply container 1 placed in the supply position shown in FIG. 16 decreases, a message promoting exchange of the developer supply container 1 is displayed on the display (unshown) provided in the image forming apparatus 100 (FIG. 1). The operator prepares a new developer supply container 1 opens the exchange cover 40 provided in the image forming apparatus 100 shown in FIG. 2, and extracts the developer supply container 1 in the direction of the arrow B shown in part (a) of FIG. 16.

In this process, as described hereinbefore, the supporting portion 4*d* of the shutter 4 can not displace in the direction of arrow C or arrow D by the limitation of the regulation rib 3*b*3 of the lower flange portion 3*b*. Therefore, FIG. 16, when the developer supply container 1 tends to move in the direction of the arrow B with the dismounting operation, the second stopper portion 4*c* of the shutter 4 abuts to the second shutter stopper portion 8*b* of the developer receiving apparatus 8, so that the shutter 4 does not displace in the direction of the arrow B. In other words, the developer supply container 1 moves relative to the shutter 4.

Thereafter, when the developer supply container 1 is drawn to the position shown in FIG. 15, the shutter 4 seals the discharge opening 3*a*4 as shown in part (b) of FIG. 15. Further, as shown in part (d) of FIG. 15, the engaging portion 11*b* of the developer receiving portion 11 displaces to the downstream lateral edge of the first guiding portion 3*b*2 from the second guiding portion 3*b*4 of the lower flange portion 3*b* with respect to the dismounting direction. As shown in part (b) of FIG. 15, the main assembly seal 13 of the developer receiving portion 11 slides on the opening seal 3*a*5 from the discharge opening 3*a*4 of the opening seal 3*a*5 to the connecting portion 3*a*6, and maintains the connection state with the connecting portion 3*a*6.

Similarly to the foregoing, as shown in part (c) of FIG. 15, the supporting portion 4*d* is in engagement with the regulation rib 3*b*3, so that it can not displace in the direction of the arrow B in the Figure. Thus, when the developer supply container 1 is taken out from the position of FIG. 15 to the position of FIG. 13, the developer supply container 1 moves relative to the shutter 4, since the shutter 4 can not displace relative to the developer receiving apparatus 8.

Subsequently, the developer supply container 1 is drawn from the developer receiving apparatus 8 to the position shown in part (a) of FIG. 14. Then, as shown in part (d) of FIG. 14, the engaging portion 11*b* slides down on the first guiding portion 3*b*2 to the position of the generally middle point of the first guiding portion 3*b*2 by the urging force of the urging member 12. Therefore, the main assembly seal 13 provided on the developer receiving portion 11 downwardly spaces from the connecting portion 3*a*6 of the opening seal 3*a*5, thus releasing the connection between the developer receiving portion 11 and the developer supply container 1. At this time, the developer is deposited substantially on the connecting portion 3*a*6 of the opening seal 3*a*5 with which the developer receiving portion 11 has been connected.

Subsequently, the developer supply container 1 is drawn from the developer receiving apparatus 8 to the position shown in part (a) of FIG. 13. Then, as shown in part (d) of FIG. 13, the engaging portion 11*b* slides down on the first guiding portion 3*b*2 to reach the upstream lateral edge with respect to dismounting direction of the first guiding portion 3*b*2, by the urging force of the urging member 12. Therefore, the developer receiving opening 11*a* of the developer receiving portion 11 released from the developer supply container 1 is sealed by the main assembly shutter 15. By this, it is avoided that foreign matter or the like enters through the developer receiving opening 11*a* and that the developer in the sub-hopper 8*c* (FIG. 4) scatters from the developer receiving opening 11*a*. The shutter 4 displaces to the connecting portion 3*a*6 of the opening seal 3*a*5 with which the main assembly seal 13 of the developer receiving portion 11 has been connected to shield the connecting portion 3*a*6 on which the developer is deposited.

Further, with the above-described dismounting operation of the developer supply container 1, the developer receiving portion 11 is guided by the first guiding portion 3*b*2, and the spacing operation from the developer supply container 1 is completed. Thereafter, as shown in part (c) of FIG. 13, the supporting portion 4*d* of the shutter 4 is disengaged from the regulation rib 3*b*3 so as to become elastically deformable. The configurations of the regulation rib 3*b*3 and/or the supporting portion 4*d* are properly selected so that the position where the engaging relation is released is substantially the same as the position where the shutter 4 enters when developer supply container 1 is not mounted to the developer receiving apparatus 8. Therefore, when the developer supply container 1 is further drawn in the direction of the arrow B shown in part (a) of FIG. 13, the second stopper portion 4*c* of the shutter 4 abuts to the second shutter stopper portion 8*b* of the developer receiving apparatus 8, as shown in part (c) of FIG. 13. By this, the second stopper portion 4*c* of the shutter 4 displaces (elastically deforms) in the direction of arrow C along a taper surface of the second shutter stopper portion 8*b*, so that the shutter 4 becomes displaceable in the direction of the arrow B relative to the developer receiving apparatus 8 together with the developer supply container 1. That is, when the developer supply container 1 is taken out of the developer receiving apparatus 8, the shutter 4 returns to the position taken when the developer supply container 1 is not mounted to the developer receiving apparatus 8. Therefore, the discharge opening 3*a*4 is assuredly sealed by the shutter 4, and therefore, the developer is not scattered from the developer supply container 1 demounted from the developer receiving apparatus 8. Even if the developer supply container 1 is mounted to the developer receiving apparatus 8, again, it can be mountable without any problem.

As described in the foregoing, according to this example, the mechanism for connecting and spacing the developer receiving portion 11 relative to the developer supply container 1 by displacement of the developer receiving portion 11 can be simplified. More particularly, a driving source and/or a drive transmission mechanism for moving the entirety of the developing device upwardly is unnecessary, and therefore, a complication of the structure of the image forming apparatus side and/or the increase in cost due to increase of the number of parts can be avoided.

In a conventional structure, a large space is required to avoid an interference with the developing device in the upward and downward movement, but according to this example, such a large space is unnecessary so that the upsizing of the image forming apparatus can be avoided.

The connection between the developer supply container 1 and the developer receiving apparatus 8 can be properly established using the mounting operation of the developer supply container 1 with minimum contamination with the developer. Similarly, utilizing the dismounting operation of the developer supply container 1, the spacing and resealing between the developer supply container 1 and the developer receiving apparatus 8 can be carried out with minimum contamination with the developer.

The developer supply container 1 of this example can cause the developer receiving portion 11 to move in the direction crossing with the mounting direction of developer supply container 1, using the guiding portions 3*b*2, 3*b*4 of the lower flange portion 3*b* with the mounting and demounting operation to the developer receiving apparatus 8. Also, it is possible to connect the developer receiving opening 11*a* upwardly with the discharge opening 3*a*4 and disconnect the developer receiving opening 11*a* from the discharge opening 3*a*4 downwardly. The developer receiving portion 11 is sufficiently small relative to developer supply container 1, and therefore, the developer contamination of the downstream side end surface Y (part (b) of FIG. 5) of the developer supply container 1 with respect to the mounting direction, with the simple and space saving structure. In addition, the developer contamination by the main assembly seal 13 slides on the protecting portion 3*b*5 of the lower flange portion 3*b* and the sliding surface (lower surface of the shutter) 4*i*.

Furthermore, after the developer receiving portion 11 is connected to the developer supply container 1 with the mounting operation of the developer supply container 1 to the developer receiving apparatus 8, the discharge opening 3*a*4 is exposed from the shutter 4 so that the discharge opening 3*a*4 and the developer receiving port 11*a* can be brought into communication with each other. In other words, the timing of each step is controlled by the guiding portions 3*b*2, 3*b*4 of the developer supply container 1, and therefore, the scattering of the developer can be suppressed assuredly with a simple and easy structure, without the being influenced by the way of operation by the operator.

In addition, after the discharge opening 3*a*4 is sealed and the developer receiving portion 11 is spaced from the developer supply container 1 with the dismounting operation of the developer supply container 1 from the developer receiving apparatus 8, the shutter 4 can shield the developer deposition portion of the opening seal 3*a*5. In other words, the timing of each step in the dismounting operation can be controlled by the guiding portions 3*b*2 and 3*b*4 of the developer supply container 1, and therefore, the scattering of the developer can be suppressed, and the developer deposition portion can be prevented from the exposing to the outside.

In the prior-art structure, the connection relation between the connecting portion and the connected portion is established indirectly through another mechanism, and therefore, it is difficulty to control the connection relation with high precision.

However, in this example, the connection relation can be established by the directly engagement between the connecting portion (developer receiving portion 11) and the connected portion (developer supply container 1). More specifically, the timing of the connection between the developer receiving portion 11 and the developer supply container 1 can be controlled easily by the positional relation, in the mounting direction, among the engaging portion 11*b*, the first and second guiding portions 3*b*2 and 3*a*4 of the lower flange portion 3*b* and discharge opening 3*a*4. In other words, the timing may deviate within the tolerances of the three elements, and therefore, very high accuracy control can be performed. Therefore, the connecting operation of the developer receiving portion 11 to the developer supply container 1 and the spacing operation from the developer supply container 1 can be carried out assuredly, with the mounting operation and the dismounting operation of the developer supply container 1.

Regarding the displacement amount of the developer receiving portion 11 in the direction crossing with the mounting direction of the developer supply container 1 can be controlled by the positions of the engaging portion 11*b* of the developer receiving portion 11 and the second engaging portion 3*b*4 of the lower flange portion 3*b*. Similarly to the foregoing, the deviation of the displacement amount may deviate within the tolerances of the two elements, and therefore, very high accuracy control can be performed. Therefore, for example, close-contact state (amount of sealing compression or the like) between the main assembly seal 13 and the discharge opening 3*a*4 can be controlled easily, so that the developer discharged from the discharge opening 3*a*4 can be fed into the developer receiving opening 11*a* assuredly.

<First Embodiment>

Figure 19:
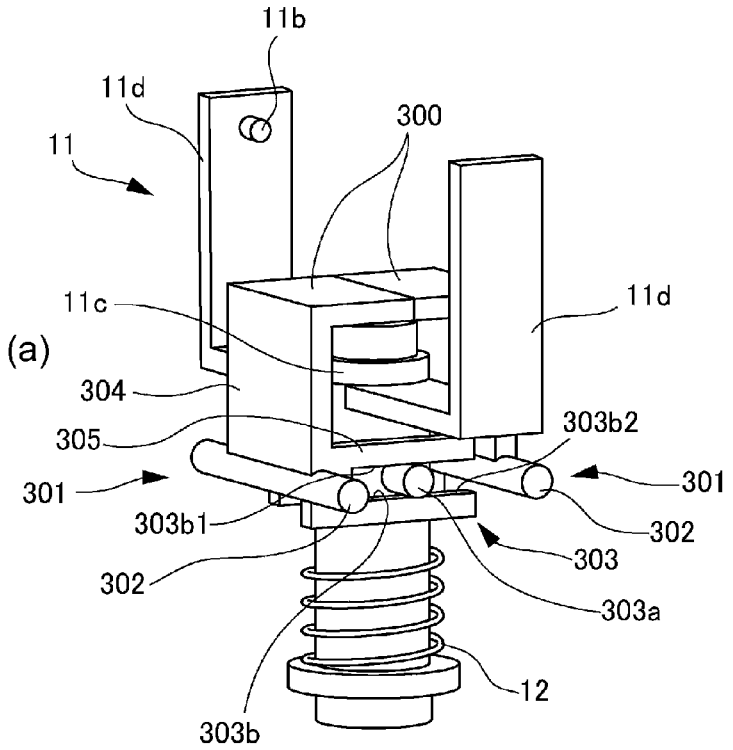
FIG. 19 is a perspective view of a part of the developer supplying apparatus according to a first embodiment of the present invention, in which (a) shows a state in which a covering member is in a covering position, and (b) shows an open position of the covering member, respectively.
Figure 19:
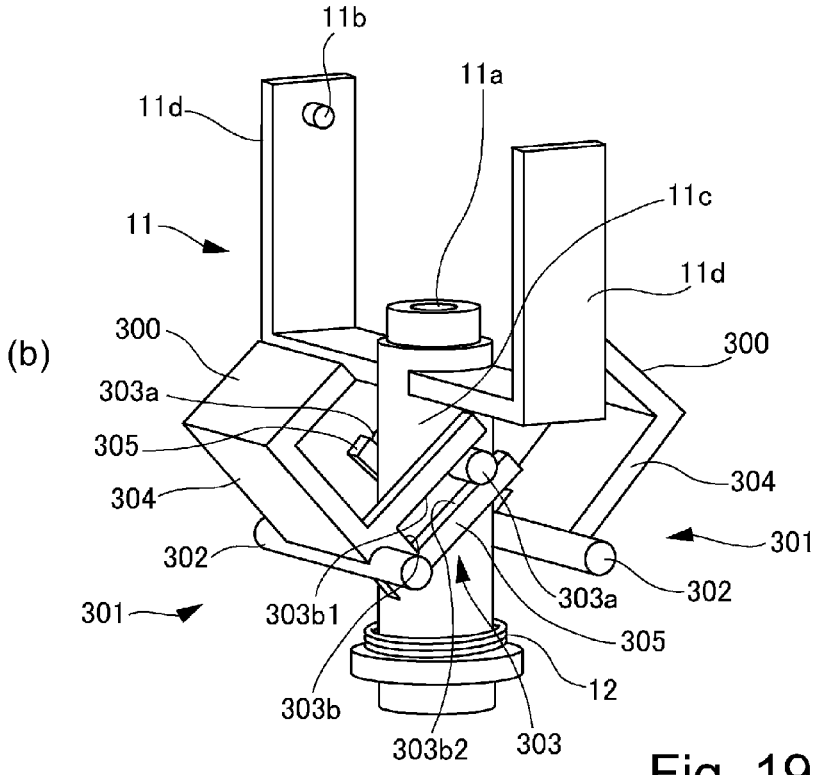

Referring to FIG. 19, a developer supplying apparatus 200 provided with the above-described developer receiving portion 11 and developer supply container 1 according to a first embodiment will be described. In the case of this embodiment, there is provided a covering member 300 movable between a covering position (part (a) of FIG. 19) covering the developer receiving opening 11*a* of the developer receiving portion 11 and an open position (part (b) of FIG. 19) opening the developer receiving opening 11*a*. The covering member 300 comprises plate-like members, and covers a part above the developer receiving opening 11*a*, that is, a developer supply container 1 side, when taking the covering position. On the other hand, in a retracted position, the covering member 300 is retracted from the upper position to permit connection of the developer receiving opening 11*a* with the discharge opening 3*a*4 of the developer supply container 1.

To accomplish this, the covering member 300 is moved in interrelation with the movement of the developer receiving portion 11 by a covering member moving mechanism 301 as a covering member moving means. That is, in interrelation with the movement of the developer receiving portion 11 moved in accordance with the mounting operation of the developer supply container 1, the covering member moving mechanism 301 moves the covering member 300 from the covering position to the open position. In this embodiment, a pair of such covering members 300 opposed to each other is moved by the covering member moving mechanism 301. The developer receiving opening 11*a* is covered by them contacting at the free end portions.

The developer receiving portion 11 comprises a main body portion 11*c*, a pair of arm portions 11*d* and engaging portions 11*b* provided projected adjacent to the free end portions of the arm portions 11*d*. The arm portions 11*d* are faced to each other at upper positions of the main body portion 11*c*, and is extended up beyond than developer receiving opening 11*a*. The covering members 300 are provided at positions away from the arm portions 11*d*, and therefore, are movable between the covering position and the open position without interference with the arm portions 11*d*. The covering member 300 may be constituted by a single plate or by three or more plates.

When the developer supply container 1 is not mounted to the developer receiving portion 11, the covering member moving mechanism 301 places the covering member 300 in the covering position. On the other hand, when the developer receiving opening 11*a* is connected to the discharge opening 3*a*4 of the developer supply container 1, the covering members 300 take the open position. The covering member moving mechanism 301 operates in interrelation with the movement of the developer receiving portion 11. To accomplish this, in this embodiment, the covering member moving mechanism 301 comprises a rotational shaft 302 and a rotating portion 303.

Is rotational shaft 302 rotatably supports the covering members 300 between the covering position and the open position. In this embodiment, the rotational shaft 302 is rotatably mounted on a fixed portion of the developer receiving apparatus 8, and therefore, it is not movable in the moving direction of the developer receiving portion 11. The rotating portion 303 imparts a relative movement between the covering member 300 and the developer receiving portion 11 with the movement of the developer receiving portion 11, and rotates the covering member 300 about the rotational shaft 302.

The rotation portion 303 includes an engaging projection 303*a*, an engaging groove 303*b* having engagement surface portions 303*b*1, 303*b*2 as portion-to-be-engaged (engaged portion). The engaging projection 303*a* is provided on the main body portion 11*c* and projects in parallel with the rotational shaft 302. In this embodiment, the engaging projection 303*a* has a cylindrical outer peripheral surface projected at a middle portion with respect to the moving direction of the developer receiving portion 11. Therefore, the engaging projection 303*a* moves together with developer receiving portion 11. The engaging groove 303*b* is provided in the covering member 300, and is engaged by the engaging projection 303*a*, and with the movement of the developer receiving portion 11, the engaging projection 303*a* makes a relative movement to rotate the covering members 300 about the rotational shaft 302.

The rotating portion 303 includes a connection plate portion 304 extended from a base end portion of the covering member 300 toward the rotational shaft 302, and an engagement plate portion 305 extended from the connection plate portion 304 in the direction along the covering member 300. The covering members 300, the connection plate portion 304 and the engagement plate portion 305 are integral with each other, and the rotational shaft 302 is fixed to a position where the connection plate portion 304 and the engagement plate portion 305 connect with each other. The engagement plate portion 305 extends perpendicularly to the rotational shaft 302 and is disposed at a position not interfering with the developer receiving portion 11.

The engaging groove 303*b* is formed by cutting the engagement plate portion 305 from the free end portion thereof to the base end portion of the rotational shaft 302. Thus, the end portion of the engaging groove 303*b* opposite from the rotational shaft 302 is open so as to receive the engaging projection 303*a*. The opposing surfaces of the engaging groove 303*b* are engagement surface portions 303*b*1, 303*b*2. The gap between the engagement surface portions 303*b*1, 303*b*2 is slightly larger than an outer diameter of the cylindrical engaging projection 303*a* to permit movement of the engaging projection 303*a* in the engaging groove 303*b*.

The covering members 300 rotated by the covering member moving mechanism 301 do not interfere with the developer supply container 1. That is, the covering members 300 and the rotational shaft 302 are disposed such that when the developer supply container 1 is mounted to the developer receiving apparatus 8 or when it is taken out of the developer receiving apparatus 8, the covering members 300 or the shaft 302 does not interfere with the developer supply container 1.

The operation of the covering members 300 of the developer supplying apparatus 200 will be described. First, the description will be made as to the state in which the developer supply container 1 is not mounted to the developer receiving portion 11. In such a state, the developer receiving opening 11*a* is spaced from the discharge opening 3*a*4, and the covering members 300 cover the developer receiving opening 11*a*, as shown in part (a) of FIG. 19. In this state, the developer receiving opening 11*a* is covered by the covering members 300, and therefore, entrance of the foreign matter through the developer receiving opening 11*a* which opens upwardly can be significantly effectively. As a result, the foreign matter in the developing device 201 can be reduced, and the image defect can be decreased.

The description will be made as to the operation at the time when the developer supply container 1 is mounted to the developer receiving portion 11. When the developer supply container 1 is mounted, the operator inserts the developer supply container 1 into the developer receiving apparatus 8, by which the bottom end portion of the developer supply container 1 passes by the upper portion of the developer receiving opening 11*a*. At this time, the movement of the developer receiving portion 11 does not start yet, and therefore, the covering members 300 remain covering the developer receiving opening 11*a*. Therefore, even if the foreign matter, if any, that is deposited on the developer supply container 1 fall, it does not or hardly enter through the developer receiving opening 11*a* into the developer supply container 1. In addition, the covering member 300 does not contact to the developer supply container 1, and therefore, the contamination of the developer supply container 1 is not directly transferred onto the covering member 300.

Subsequently, when the developer supply container 1 is inserted further into the developer receiving apparatus 8 the first guide portion 3*b*2 of the developer supply container 1 shown in FIGS. 13, 14 engages with the engaging portion 11*b* of the developer receiving portion 11 to start lifting the developer receiving portion 11. When it starts, the engaging projection 303*a* slides while being in engagement with the engagement surface portion 303*b*1 of the engaging groove 303*b* to rotate the covering member 300 about the rotational shaft 302. At this time, the covering members 300 rotate to retract away from the developer receiving opening 11*a* and does not blocks the movement of the developer receiving portion 11. In addition, the covering members 300 do not contact to the developer supply container 1 even during the rotation, and therefore, does not block the movement of the developer supply container 1, and in addition, the contamination of the developer supply container 1 is not directly transferred.

As shown in FIGS. 15, 16, when the developer supply container 1 is mounted to the developer receiving apparatus 8 and the developer receiving opening 11*a* close-contacts the opening seal 3*a*5 of the developer supply container 1, the covering members 300 are in the open state as shown in part (b) of FIG. 19. That is, in a state that the engaging portion 11*b* is engaged with the second guide portion 3*b*4 as a result of mounting of the developer supply container 1 to the developer receiving apparatus 8, the developer receiving opening 11*a* is close-contacted to the opening seal 3*a*5. By further insertion of the developer supply container 1, the discharge opening 3*a*4 is connected to the developer receiving opening 11*a*. At this time, the covering members 300 stop at positions retracted from the developer receiving opening 11*a*, and therefore, they do not obstruct the connection between the developer receiving portion 11 and the developer supply container 1.

Thus, the covering members 300 are rotated in interrelation with the movement of the developer receiving portion 11, and therefore, they do not rotate before the start of the raising of the developer receiving portion 11. In other words, until the start of the connection of the developer receiving portion 11, the entrance of the foreign matter through the developer receiving opening 11*a* can be prevented effectively.

The operation at the time when the developer supply container 1 is dismounted from the developer receiving portion 11 will be described. When the developer supply container 1 is dismounted, the operator removes the developer supply container 1 from the developer receiving apparatus 8. When the removal of the developer supply container 1 starts, the second guide portion 3*b*4 is disengaged from the engaging portion 11*b*, and thereafter, the developer supply container 1 starts removal from the developer receiving portion 11. In the removal of the developer receiving portion 11, the engaging projection 303*a* slides along the engagement surface portion 303*b*2 of the engaging groove 303*b*, so that the covering member 300*s* tarts to rotate about the rotational shaft 302 in the covering direction. That is, the rotation of the covering member 300 in the covering direction for the developer receiving opening 11*a* also starts.

When the removal of the developer receiving portion 11 is completed, the developer receiving opening 11*a* is covered by the covering member 300. At this time, the covering member 300 does not contact to the developer supply container 1, and therefore, the contamination of the developer supply container 1 is not directly transferred. Since the removing operation of the developer supply container 1 continues then, it is possible that the foreign matter may fall, but the developer receiving opening 11*a* is covered by the covering member 300, and therefore, the entrance of the foreign matter into the developer receiving opening 11*a* can be prevented effectively.

In this manner, in this embodiment, the developer receiving opening 11*a* is covered by the covering member 300 in interrelation with the movement of the developer receiving portion 11, and is kept covered when the developer supply container 1 is not mounted to the developer receiving portion 11. Specifically, until the start of the movement of the developer receiving portion 11 with the mounting operation of the developer supply container 1, the covering member 300 covers the developer receiving opening 11*a*. When the movement of the developer receiving portion 11 wherein the dismounting operation of the developer supply container 1 starts, the covering member 300 rotates in the direction of covering the developer receiving opening 11*a*, and after the completion of the movement of the developer receiving portion 11, the developer receiving opening 11*a* is covered by the covering member 300.

On the other hand, when the developer receiving opening 11*a* contacts with the discharge opening 3*a*4, the covering member 300 opens the developer receiving opening 11*a*. In other words, wherein the structure of covering the developer receiving opening 11*a* by the covering member 300, the connection of the developer receiving opening 11*a* with the discharge opening 3*a*4 is enabled by the rotation of the covering member 300 in the direction retracting from the developer receiving opening 11*a* with the movement of the developer receiving portion 11.

Therefore, the entrance of the foreign matter into the developer receiving opening 11*a* can be suppressed by the structure in which the developer receiving opening 11*a* is connected with the discharge opening 3*a*4 of the developer supply container 1 by moving the developer receiving portion 11 having the developer receiving opening 11*a* for receiving the developer.

In this embodiment, the covering member moving mechanism 301 for operating the covering member 300 is operated in interrelation with the movement of the developer receiving portion 11. Therefore, it is unnecessary to employ an additional driving source for opening and locking the opening by the covering member 300. The operation of the covering member 300 is mechanically interrelated with the movement of the developer receiving portion 11. Therefore, when the developer receiving opening 11*a* is connected with the discharge opening 3*a*4, the covering member 300 is assuredly in the open state, and when the developer supply container 1 is not mounted to the developer receiving portion 11, the covering member 300 is assuredly in the covering state.

In the foregoing description, the rotational shaft 302 is fixed to the fixed portion of the developer receiving apparatus 8, and it slides relative to the engaging projection 303*a* in the engaging groove 303*b* integral with the covering member 300, so that the covering member 300 is rotated in interrelation with the movement of the developer receiving portion 11. However, the mechanism for rotating the covering member 300 in interrelation with the movement of the developer receiving portion 11 is not restricted to the structure. For example, a rotational shaft is provided on the developer receiving portion 11, and the covering member 300 is rotatable about the rotational shaft, wherein the covering member 300 is provided at the position of the developer receiving apparatus 8 so as to be rotatable in interrelation with the movement of the developer receiving portion 11.

<Second Embodiment>

Figure 20:
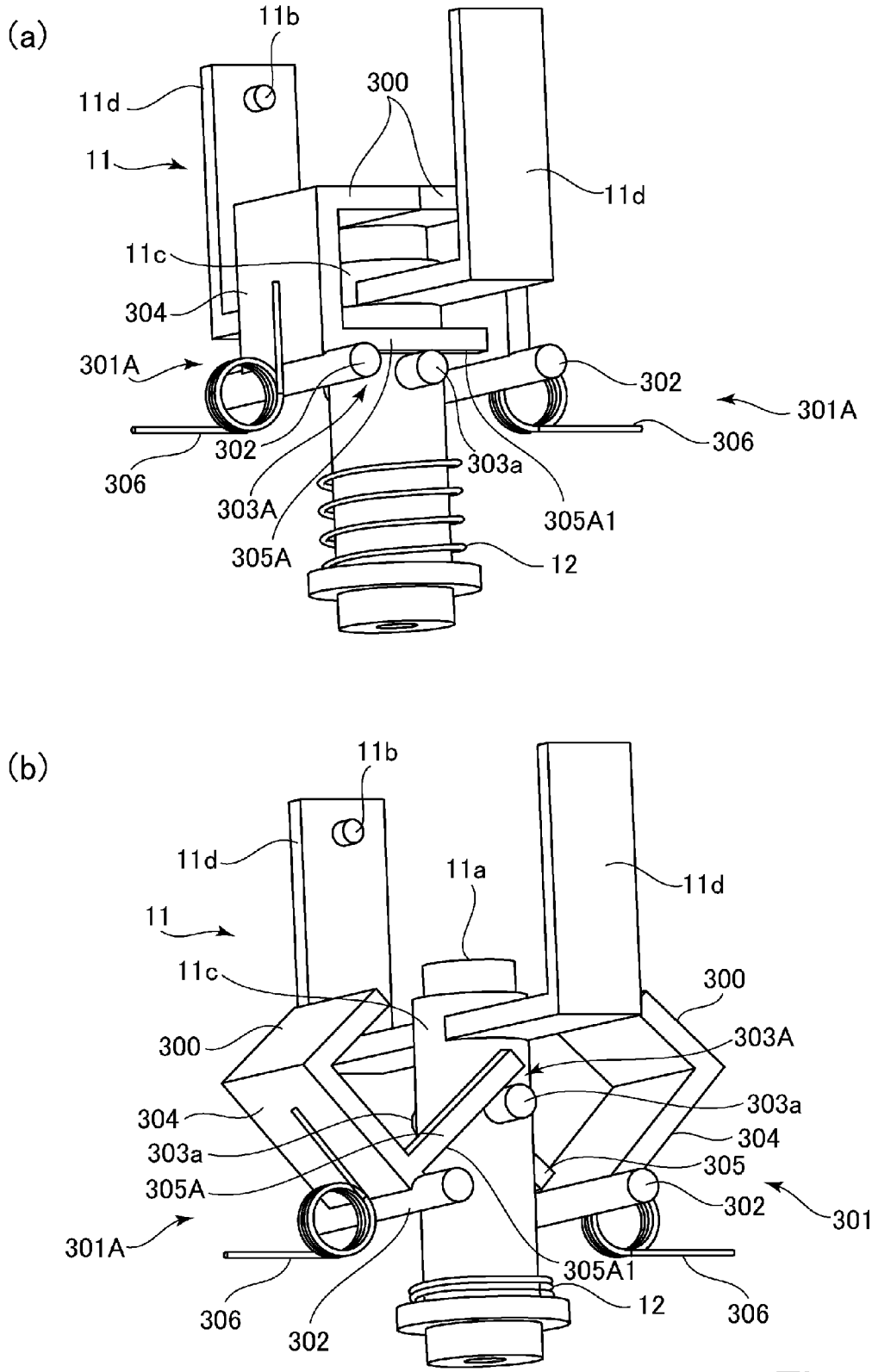
FIG. 20 is a perspective view of a part of the developer supplying apparatus according to a second embodiment of the present invention, in which (a) shows a state in which a covering member is in a covering position, and (b) shows an open position of the covering member, respectively.

Referring to FIG. 20, a second embodiment will be described, in which the present invention is embodied in the developer supplying apparatus 200 provided with the above-described developer receiving portion 11 and developer supply container 1. In this embodiment, a spring 306 for urging the covering member 300 in the covering direction is provided. The other structures and functions are fundamentally the same as with the first embodiment, and therefore, in the description of this embodiment, the same reference numerals as in Embodiment 1 are assigned to the elements having the corresponding functions in this embodiment, and the detailed description thereof is omitted for simplicity.

The covering member moving mechanism 301A as the covering member moving means of this embodiment includes a spring 306 as an urging means for urging the covering member 300 toward the covering position. Specifically, the spring 306 is provided between a connection plate portion 304 integral with the covering member 300 and a fixed portion of the developer receiving apparatus 8, and the covering member 300 is rotationally urged toward the covering position. In the illustrated example, the spring 306 is a twisted coil spring which applies the urging force to rotate the covering member 300.

In addition, the rotation portion 303A of this embodiment includes a connection plate portion 304 extended from the base end portion of the covering member 300 toward a rotational shaft 302 and includes an engagement plate portion 305A extended from the connection plate portion 304 along the covering member 300. In the case of this embodiment, the engagement plate portion 305A is not provided with the engaging groove as in the first embodiment. In place thereof, one side surface of the engagement plate portion 305A is used as an engagement surface portion 305A1 as a portion-to-be-engaged, and is contacted to an engaging projection 303*a*. The engagement surface portion 305A1 is disposed in a side where the developer receiving portion 11 moves to the discharge opening 3*a*4 relative to the engaging projection 303*a*, more particularly, in an upper side in the illustrated example.

In this embodiment, with this structure, when the developer supply container 1 is mounted to the developer receiving apparatus 8, the developer receiving portion 11 is raised in interrelation with the mounting operation, so that the engaging projection 303*a* slides along the engagement surface portion 305A1. By this, the covering member 300 rotates toward the open position (part (b) of FIG. 20) about the rotational shaft 302 against the urging force of the spring 306.

On the other hand, when the developer supply container 1 is removed from the developer receiving apparatus 8, the developer receiving portion 11 moves in the direction away from the developer supply container 1 in interrelation with the removing operation, and the engaging projection 303*a* moves in the direction of disengaging from the engagement surface portion 305A1. At this time, since the covering member 300 is urged toward the covering position (part (a) of FIG. 20) by the spring 306, the covering member 300 rotates toward the covering position about the rotational shaft 302 by the urging force of the spring 306.

In this embodiment, the spring 306 urges the covering member 300 in the covering direction, and therefore, it is unnecessary to engage the engaging projection 303*a* in an engaging groove 303*b*. That is, the engaging projection 303*a* is the engagement surface portion 305A1 which is one side surface of the engagement plate portion 305A. However, the engaging projection 303*a* in this embodiment may be engaged with the engaging groove 303*b* similarly to the first embodiment.

Furthermore, the covering member 300 may be urged toward the open position by a spring. However, with such a structure, the engagement surface portion of the covering member 300 side which is engaged with the engaging projection 303*a* is disposed in a side where the developer receiving portion 11 removes from the discharge opening 3*a*4 relative to the engaging projection 303*a*, more specifically, in the lower side in the illustrated example. By this, when the developer receiving apparatus 8 is mounted to the developer supply container 1, the developer receiving portion 11 is raised in interrelation with the mounting operation, and the engaging projection 303*a* moves in the direction of disengaging from the engagement surface portion. Then, the covering member 300 is moved toward the open position by the urging force of the spring. On the other hand, when the developer supply container 1 is removed from the developer receiving apparatus 8, the developer receiving portion 11 moves in the direction of disengaging from the developer supply container 1 in interrelation with the dismounting operation, and the engaging projection 303*a* slides along the engagement surface portion. Then, the covering member 300 rotates toward the covering position against the urging force of the spring.

<Third Embodiment>

Figure 21:
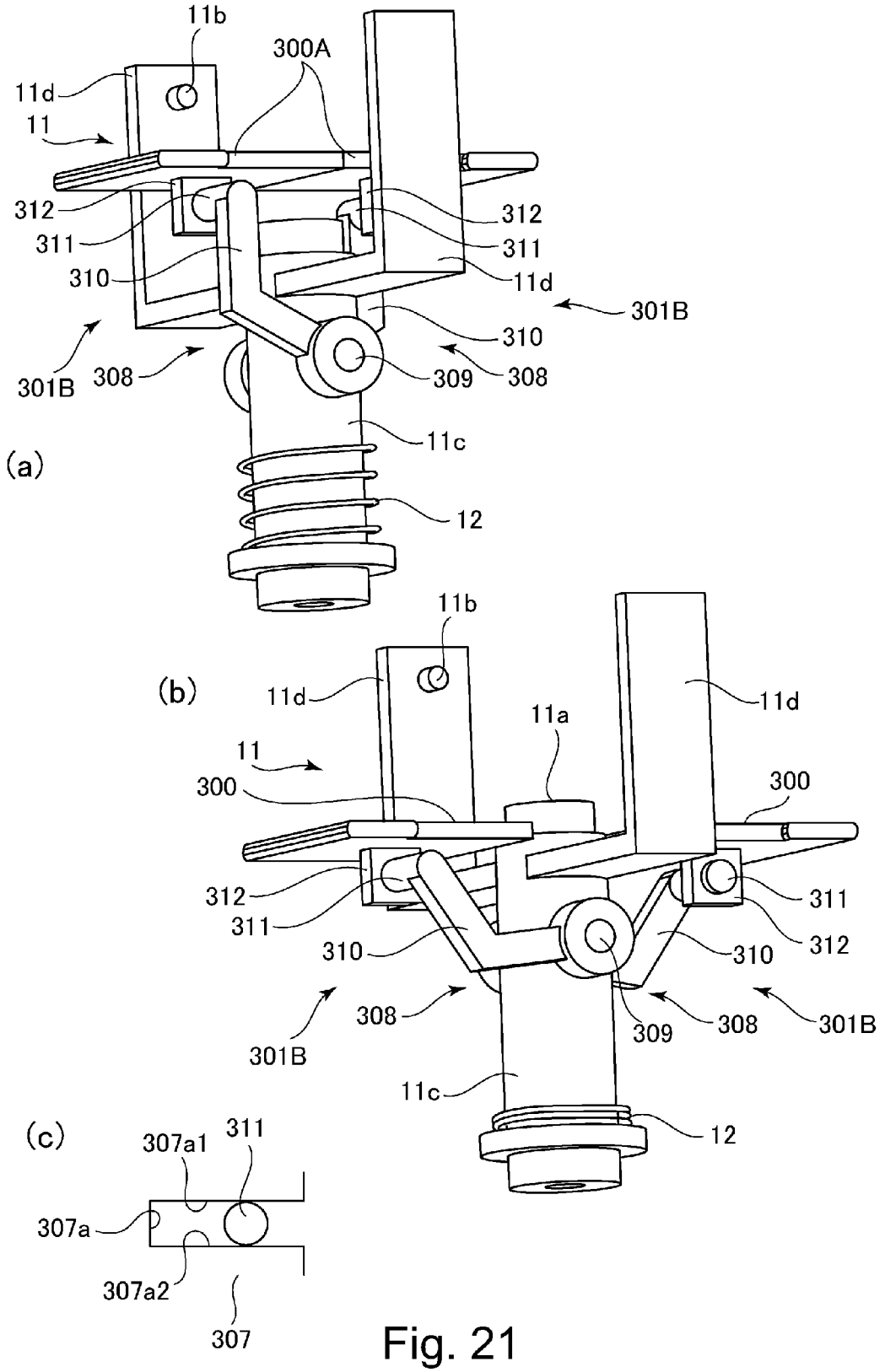
FIG. 21 is a perspective view of a part of the developer supplying apparatus according to a third embodiment of the present invention, in which (a) shows a state in which a covering member is in a covering position, (b) shows an open position of the covering member, respectively, and (c) shows a shaft and guiding grooves.

Referring to FIG. 21, a third embodiment will be described, in which the present invention is embodied in a developer supplying apparatus 200 provided with the above-described developer receiving portion 11 and developer supply container 1. In this embodiment, a covering member moving mechanism 301B as a covering member moving means slides the covering member 300A between a covering position and an open position in a direction crossing with a moving direction of the developer receiving portion 11 in interrelation with the movement of the developer receiving portion 11. To accomplish this, in this embodiment, the covering member moving mechanism 301B includes a slide guiding portion 307 and a sliding operation portion 308. The other structures and functions are fundamentally the same as with the first embodiment, and therefore, in the description of this embodiment, the same reference numerals as in Embodiment 1 are assigned to the elements having the corresponding functions in this embodiment, and the detailed description thereof is omitted for simplicity.

The sliding operation portion 308 imparts a relative movement between the covering member 300A and the developer receiving portion 11 with the movement of the developer receiving portion 11, and moves the covering member 300A along the slide guiding portion 307. The sliding operation portion 308 includes a first shaft 309, a swingable arm 310 and a second shaft 311. The first shaft 309 is provided on the main body portion 11*c* of the developer receiving portion 11, extending in the direction perpendicular to a moving direction of the developer receiving portion 11 and to an guiding direction (sliding direction) of the slide guiding portion 307. The swingable arm 310 is swingably supported by the first shaft 309 at one end portion. The second shaft 311 rotatably supports the other end portion of the swingable arm 310 on the covering member 300A. The covering member 300A is provided with an integral shaft receiving portion 312 for rotatably supporting the second shaft 311 six to the other end portion of the swingable arm 310. In other words, the covering member 300A is supported by the other end portion of the swingable arm 310 through the second shaft 311 and the shaft receiving portion 312.

The slide guiding portion 307 is provided at a fixed portion of the developer receiving apparatus 8, and guides the sliding motion of the covering member 300A between the covering position (part (a) of FIG. 21) and the open position (part (b) of FIG. 21) in the direction (sliding direction) crossing with the moving direction of the developer receiving portion 11. As shown in part (c) of FIG. 21, the slide guiding portion 307 is provided with a guide groove 307*a* for guiding the second shaft 311 rotatably supported by the shaft receiving portion 312 of covering member 300A in the sliding direction. That is, the guide groove 307*a* is defined by guiding surfaces 307*a*1, 307*a*2 facing each other along the moving direction developer receiving portion 11. The gap between the guiding surfaces 307*a*1, 307*a*2 is slightly larger than an outer diameter of the second shaft 311 to permit the relative movement of the second shaft 311 in the guide groove 307*a*.

In the case of this embodiment, with such a structure, when the developer supply container 1 is mounted to the developer receiving apparatus 8, the developer receiving portion 11 is raised in interrelation with the mounting operation, and one end portion of the swingable arm 310 supported by the first shaft 309 starts to move. Then, the second shaft 311 fixed to the other end portion of the swingable arm 310 slides while it is in engagement with the guiding surface 307*a*1 of the guide groove 307*a*, and the swingable arm 310 rotates about the first shaft 309 in such a direction that the other end portion is away from the developer receiving portion 11. At this time, since the second shaft 311 is guided by the guide groove 307*a*, the covering member 300A also moves in the direction away from the developer receiving portion 11 together with the second shaft 311, that is, toward the open position. The second shaft 311 moves while rotating in the guide groove 307*a* by the rotation of the swingable arm 310, but it is rotatable relative to the covering member 300A by the shaft receiving portion 312. Therefore, the attitude of the covering member 300A does not change despite the rotation of the second shaft 311, and moves along the sliding direction.

On the other hand, when the developer supply container 1 is dismounted from the developer receiving apparatus 8, the developer receiving portion 11 moves in the direction of dismounting from the developer supply container 1 in interrelation with the dismounting operation, and the one end portion of the swingable arm 310 supported by the first shaft 309 starts to move in the same direction. Then, the swingable arm 310 rotates about the first shaft 309 in such a direction that the other end portion moves toward the developer receiving portion 11, while the second shaft 311 fixed to the other end portion of the swingable arm 310 is in engagement with the guiding surface 307*a*2 of the guide groove 307*a*. At this time, since the second shaft 311 is guided by the guide groove 307*a*, the covering member 300A supported by the second shaft 311 through the shaft receiving portion 312 moves toward the developer receiving portion 11 together with the second shaft 311, that is, toward the covering position.

In the case of this embodiment, the covering member 300A slides in the direction crossing with the moving direction of the developer receiving portion 11 by the sliding operation portion 308, and therefore, the interference with the developer supply container 1 can be further avoided. The structure of the sliding operation portion 308 is not restricted to the above-described example. For example, the covering member 300A per se may be guided by a slide guiding portion.

<Fourth Embodiment>

Figure 22:
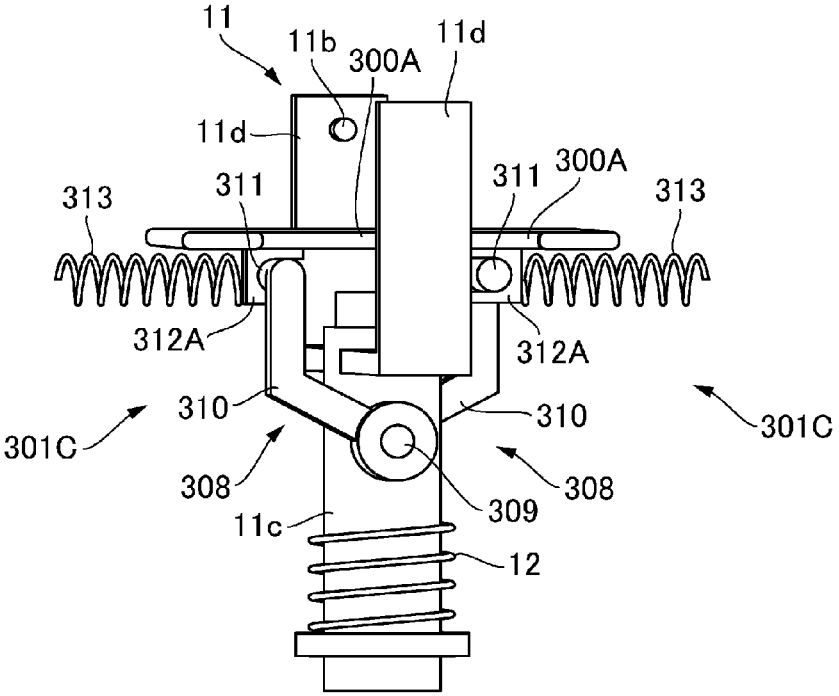
FIG. 22 is a perspective view of a part of the developer supplying apparatus according to a fourth embodiment of the present invention, in which (a) shows a state in which a covering member is in a covering position, and (b) shows an open position of the covering member, respectively.
Figure 22:
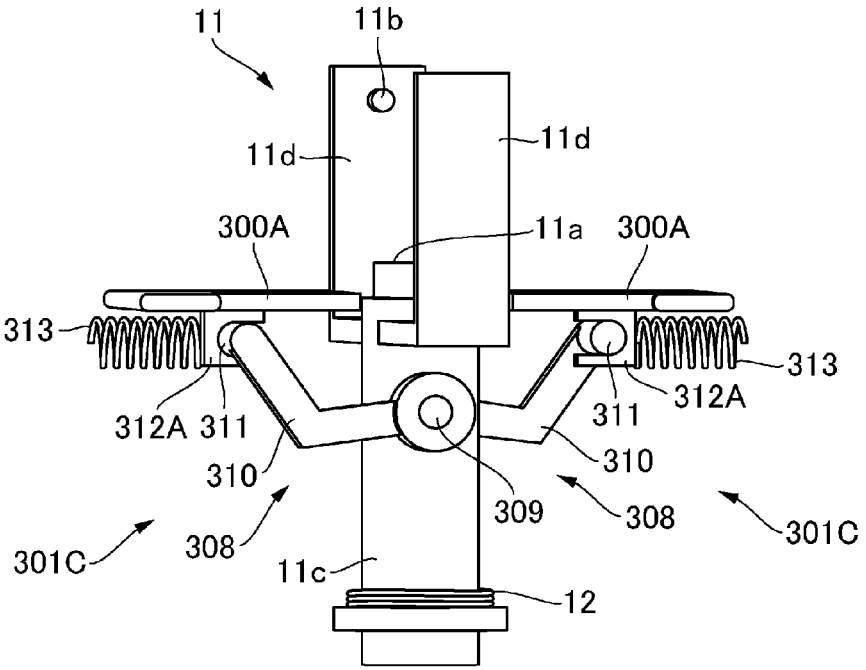

Referring to FIG. 22, a fourth embodiment will be described, in which the present invention is embodied in a developer supplying apparatus 200 provided with the above-described developer receiving portion 11 and developer supply container 1. In this embodiment, a spring 313 for urging the covering member 300A in the covering direction is provided. In the description of this embodiment, the same reference numerals as in Embodiment 3 are assigned to the elements having the corresponding functions in this embodiment, and the detailed description thereof is omitted for simplicity.

The covering member moving mechanism 301C as the covering member moving means of this embodiment includes a spring 313 as an urging means for urging the covering member 300A toward the covering position. More specifically, the spring 313 is disposed between a shaft receiving portion 312A integral with a covering member 300 and a fixed portion of the developer receiving apparatus 8, and urges the covering member 300A toward the covering position. In the illustrated example, the spring 313 is a compression coil spring which applies an urging force to the covering member 300A in the sliding direction.

The shaft receiving portion 312A of this embodiment is provided with a cut-away portion at a side of the supporting hole supporting the second shaft 311 where the covering member 300A moves toward the covering position. Through the cut-away portion, the second shaft 311 can be placed in the supporting hole of shaft receiving portion 312. Also in this embodiment, similarly to the third embodiment, the second shaft 311 may be placed in a supporting hole not having the cut-away portion.

In the case of this embodiment, with such a structure, when the developer supply container 1 is mounted to the developer receiving apparatus 8, the developer receiving portion 11 is raised in interrelation with the mounting operation, and one end portion of the swingable arm 310 supported by the first shaft 309 starts to move. Then, the second shaft 311 fixed to the other end portion of the swingable arm 310 slides while it is in engagement with the guiding surface 307*a*1 (part (c) of FIG. 21) of the guide groove 307*a*, and the swingable arm 310 rotates about the first shaft 309 in such a direction that the other end portion is away from the developer receiving portion 11. At this time, the second shaft 311 is guided by the guide groove 307*a*. Therefore, the covering member 300A supported by the second shaft 311 the shaft receiving portion 312 also moves toward the open position (part (b) of FIG. 22) against the urging force of the spring 313.

On the other hand, when the developer supply container 1 is dismounted from the developer receiving apparatus 8, the developer receiving portion 11 moves in the direction of dismounting from the developer supply container 1 in interrelation with the dismounting operation, and the one end portion of the swingable arm 310 supported by the first shaft 309 starts to move in the same direction Then, the swingable arm 310 rotates about the first shaft 309 in such a direction that the other end portion moves toward the developer receiving portion 11, while the second shaft 311 fixed to the other end portion of the swingable arm 310 is in engagement with the guiding surface 307*a*2 (part (c) of FIG. 21) of the guide groove 307*a*. At this time, since the covering member 300A is urged toward the covering position (part (a) of FIG. 22) by the spring 313, the second shaft 311 moves along the guide groove 307*a*. Then, the covering member 300A supported by the second shaft 311 through the shaft receiving portion 312 also moves toward the covering position.

Furthermore, the covering member 300A may be urged toward the open position by a spring. However, with this structure, the cut-away portion of the supporting hole supporting the second shaft 311 of the shaft receiving portion 312A is provided in a side where the covering member 300A moves toward the open position. By this, when the developer supply container 1 is mounted to the developer receiving apparatus 8, the developer receiving portion 11 is raised in interrelation with the mounting operation, and the second shaft 311 moves away from the developer receiving portion 11 by the rotation of the swingable arm 310. And, the covering member 300A is moved toward the open position by the urging force of the spring. On the other hand, when the developer supply container 1 is dismounted from the developer receiving apparatus 8, the developer receiving portion 11 moves in the direction of dismounting from the developer supply container 1 in interrelation with the dismounting operation. Then, the second shaft 311 is moved toward the developer receiving portion 11 by the rotation of the swingable arm 310, and the covering member 300A moves toward the covering position against the urging force of the spring.

In the case of the present invention, in interrelation with the movement of the developer receiving portion caused by the mounting operation of the developer supply container, the covering member is moved from the covering position to the open position. Therefore, in the structure in which by moving the developer receiving portion having a receiving opening for receiving the developer, the receiving opening is connected with a discharge opening of the developer supply container, the entering of the foreign matter into the receiving opening can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application <add other application numbers, if appropriate>which is<or are, if more than one>hereby incorporated by reference herein in its<or their, if more than one> entirety.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 167338/2013 filed Aug. 12, 2013, which is hereby incorporated by reference.

What is claimed is:

1. A developer receiving apparatus for receiving a developer supplied from a developer supply container which is detachably mountable to said developer receiving apparatus, said developer receiving apparatus comprising:

a receiving portion displacably provided in said receiving apparatus and configured to receive the developer supplied from the supply container, said receiving portion including a receiving port configured to receive the developer and a first engaging portion engageable with the supply container to displace said receiving portion toward the supply container so as to connect said receiving portion with the supply container in a mounting operation of the supply container; and a covering member displacably provided in said receiving apparatus and covering an upper part of the receiving port, said covering member taking a closing position closing the upper part of said receiving port when the supply container is not mounted, and said covering member including a second engaging portion engageable with said receiving portion to displace said covering member to a retracted position retracted from the closing position to permit said receiving portion to connect with the supply container in the mounting operation of the supply container.

2. An apparatus according to claim 1, wherein said covering member is provided with a rotational shaft supporting said covering member rotatably between the closing position and the retracted position, and said second engaging portion rotates said covering member about said rotational shaft with a movement of said receiving portion.

3. An apparatus according to claim 2, further comprising a portion-to-be-engaged provided in said receiving portion engaged with said second engaging portion and provided with an engaging projection projecting in a direction perpendicular to said rotational shaft.

4. An apparatus according to claim 1, wherein said covering member includes a first shield portion provided rotatably about a first rotational axis and configured to cover part of the upper part of said receiving port, and a second shield portion provided rotatably about a second rotational axis and configured to cover a remaining part of the upper part of said receiving port.

5. An apparatus according to claim 4, wherein said first shield portion and said second shield portion are rotatable in opposite directions so as to separate from each other in the mounting operation of the supply container.

6. An apparatus according to claim 1, further comprising an urging portion for urging said covering member in a direction from the retracted position to the closing position.

* * * * *